US006042290A

United States Patent [19]

Ishikawa et al.

[11] Patent Number: 6,042,290

[45] Date of Patent: Mar. 28, 2000

[54] WRITING TOOL

[75] Inventors: Shinichi Ishikawa; Matsuhei Toyama, both of Tokyo; Morio Akiyama, Kanagawa-ken, all of Japan

[73] Assignee: Zebra Co., Ltd., Tokyo, Japan

[21] Appl. No.: 08/793,602

[22] PCT Filed: Jul. 10, 1996

[86] PCT No.: PCT/JP96/01903

§ 371 Date: Mar. 5, 1997

§ 102(e) Date: Mar. 5, 1997

[87] PCT Pub. No.: WO97/03845

PCT Pub. Date: Feb. 6, 1997

[30] Foreign Application Priority Data

Jul. 14, 1995 [JP] Japan ..... 7-178655
Sep. 8, 1995 [JP] Japan ..... 7-231458

[51] Int. Cl.[7] ..... B43K 7/10

[52] U.S. Cl. ..... 401/214; 401/209

[58] Field of Search ..... 401/214, 209, 401/216, 212

[56] References Cited

U.S. PATENT DOCUMENTS 2,107,424 2/1938 Platt ..... 401/214
2,930,062 3/1960 Reimann ..... 401/214
3,819,285 6/1974 Andrews et al. .
3,902,815 9/1975 Williams ..... 401/214

FOREIGN PATENT DOCUMENTS 0621141 10/1994 European Pat. Off. .
2203750 5/1974 France .
6-11873 2/1994 Japan .

OTHER PUBLICATIONS

A copy of a PCT Search Report issued in PCT/JP 96/01903.

*Primary Examiner*—David J. Walczak
*Attorney, Agent, or Firm*—Greenblum & Berstein P.L.C.

[57] ABSTRACT

A writing tool provided with a valve construction in which a rotary body embraced in a ball house at the extreme end of a tip is urged forward by means of a coiled spring inserted into the tip to be partly projected, in which state the rotary body comes in contact with an inwardly directed extreme end edge to prevent ink or an applying liquid from flowing out, and when in use, the rotary body partly projecting from the extreme end of the tip presses a paper surface to retreat (immerse) the rotary body against the force of the coiled spring to transfer the ink or the applying liquid onto the paper, wherein the coiled spring is formed to be shorter than the tip. The coiled spring is concentrically supported on the extreme end of a telescope having a liquid conducting portion leading to at least front and rear ends and the telescope is fixedly inserted into the tip, whereby the coiled spring is brought into contact with the rotary body in the state where the coiled spring is concentrically supported within the tip by the telescope.

2 Claims, 17 Drawing Sheets

WRITING TOOL

FIELD OF THE INVENTION

The present invention relates to a writing tool, and particularly to a tip of the writing tool having a valve construction designed such that a rotary body, mounted in a ball house within the extreme end of a tip connected to the extreme end of a liquid tank filled with ink or an applying liquid, is urged forward by a coiled spring inserted and present within the tip, into contact with an inwardly directed extreme end edge of the tip so that the ink or the applying ink does not leak. When in use, the rotary body, a part of which is projected from the extreme end of the tip, is pressed against a paper surface to retreat into the rotary body against the force of the coiled spring, whereby the ink or the applying liquid is transferred onto a paper.

DESCRIPTION OF THE PRIOR ART

The tip of the writing tool of this kind has been generally known so for in the construction exemplified in FIG. 20 (as disclosed in Japanese Utility Model Laid-Open No. Hei 6-11873).

A tip 30 of the conventional writing tool is designed such that a rotary body 32 is mounted in a ball house 31 within an extreme end thereof. A washer 33 is provided at the rear end of the tip 30. A coiled spring 34 having substantially the same length as that of the tip 30 is inserted and provided between the washer 33 and the rotary body 32, whereby the rotary body 32 is urged into contact with an inwardly directed extreme end edge 31-1 of the ball house 31. An applying ink within a liquid tank 35 therefore does not flow out of a liquid applying port 36 of the ball house 31. That is, the rotary body 32 and the inwardly directed extreme end edge 31-1 of the ball house 31 form a closed valve.

The tip used in the writing tool of this kind is formed from a relatively small diameter metallic pipe. Accordingly, the coiled spring 34 must also have a smaller diameter. A high degree of processing technology and incorporating technology with high precision is required, with a resultant high processing cost. That is, coiled spring 34 must be manufactured about the same length as that of the tip using a high degree of processing technology increasing the processing cost for the coiled spring.

Further, since the coiled spring 34 extends the full length of the tip, the coiled spring 34 forms an obstacle which impedes the flow of liquid from liquid tank 35 to ball house 31 through the tip 30.

Furthermore, to incorporate coiled spring 34 into the tip 30, the coiled spring 34 must be arranged to apply suitable (spring) force against washer 33. This makes it difficult to concentrically arrange the coiled spring 34 within the tip 30. That is, in the absence of a support for the coiled spring 34 which centers it relative to the core of the tip 30, the washer 35 is pressed into the rear end of the tip 30 to incorporate and arrange the coiled spring 34 in the tip 30. This makes it difficult to center the tip 30 relative to the core. Therefore, the coiled spring 34 may deviate when incorporated into the tip 30. Although the coiled spring 34 should be properly inserted into the tip 30 in the centered state, since the coiled spring 34 is not supported, the deviation would occur during use for a short period of time. During any such deviation, the force applied to rotary body 32 may not be balanced, making it difficult to evenly place the rotary body 32 in contact with the inwardly-directed extreme end edge 31-1 of the ball house 31. That is, the valve constituted by the rotary body 32 and the inwardly-directed extreme end edge 31-1 of the ball house 31 may not be properly closed, such that the applying liquid may leak out.

Further, when the writing tool of this kind is put on a pen stand or the like with the tip directed upward, the applying liquid within the tip returns to the liquid tank due to gravity. If the applying liquid within the tip does not quickly return to the liquid tank, the applying liquid remaining in the tip solidifies over time, which may impede expansion and contraction of the coiled spring. In other words, the valve cannot open and close properly due to clogging. Particularly, in a writing tool using ink or an applying liquid in which a solid component which precipitates and agglomerates over time to solidify into a cake-like substance which mixes with a high volatile liquid component, a so-called solvent, the hard cake substance will disable the coil spring.

However, the tip of the aforementioned conventional writing tool is designed so that a washer having a liquid passage port which is smaller than a diameter of the tip is provided interiorly of the rear end of the tip, a flow of the ink or the applying liquid back to the liquid tank due to its own weight becomes broken at an opening at the rear end of the tip having the washer provided therein, producing a curtain from surface tension over the open part at the rear end of the tip (including the liquid passage port of the washer). The curtain induces clogging, which impedes a low of ink or an applying liquid returning to the liquid tank.

Incidentally, the rotary body and the coiled spring may be incorporated into the tip by first putting the rotary body into the ball house from the opening at the extreme end of the tip, and caulking the open edge at the extreme end thereof inwardly to rotatably mount the rotary body therein. Thereafter, the coiled spring is placed in contact with the rotary body from the opening at the rear end of the tip, and the other end thereof is inserted to be projected relative to the ball house.

OBJECTS AND SUMMARY OF THE INVENTION

Therefore, an object of the present invention is to reduce the processing cost for processing a coiled spring.

A further object of the invention is to simply and positively perform centering relative to a core of a tip when the coiled spring is incorporated into the tip, and even after incorporation and insertion, to firmly support the coiled spring within the tip in the state where no deviation in center occurs.

Another object of the invention is to quickly supply an ink or an applying liquid to a ball house without being subjected to flow resistance.

Still another object of the invention is to stand the tool with the tip upward whereby ink or an applying liquid remaining in the tip may return to a liquid tank quickly.

Other objects of the invention will become apparent from the ensuing detailed description and the accompanying drawings.

These objects can be achieved by writing tool provided by the present invention.

According to the present invention, there is provided a writing tool in which a tip embracing a rotary body in contact with an inwardly-directed extreme end edge in a state urged forward by means of a coiled spring to project a port thereof within a ball house within the extreme end is connected to a liquid tank, wherein said coiled spring is formed to be shorter than the tip, and a telescope concentrically supporting said coiled spring at the extreme end side and having a liquid inducting portion leading to at least front end rear ends is fixedly inserted into the tip to place the coiled spring in spring contact with said rotary body.

The telescope is formed in the form of a rod capable of being fixedly inserted into the tip, a spring support portion which is shallower than at least a length of the coiled spring from the extreme end thereof and is larger In Inside diameter than the outside diameter of the coiled spring is concentrically provided, and one end side of the coiled spring is Immersed in and supported by said spring support portion. A large diameter fixed portion having the diameter substantially equal to the inside diameter of the tip is provided at the rear end side of the telescope to form the telescope into a rod with a shoulder, the telescope being pressed and inserted into the tip by the large diameter fixed portion. The telescope is formed to have the length from an opening at the rear end of the tip to the vicinity of the ball house at the extreme end, the outside diameter of the telescope from the proximal end of the shoulder of the large diameter fixed portion at the rear end thereof to an open edge of the spring support portion at the extreme end is formed to be smaller than the inside diameter of the tip, a second liquid conducting portion is secured between the small diameter loose portion and the inner surface of the tip, and a liquid flowing hole leading to the second liquid conducting portion is formed from the rear end of said large diameter fixed portion toward the proximal end of the shoulder.

Further, in place of said large diameter fixed portion, a plurality of fixed longitudinal ribs projected at a height having substantially the same diameter as the inside diameter of the tip are peripherally provided on the rear end side of the telescope so that the telescope is pressed and Inserted by the fixed longitudinal ribs.

Further, the liquid conducting portion is formed into a hole which is concentric from the rear end of the telescope toward the vicinity of the spring support portion at the extreme end thereof, a plurality of liquid conducting longitudinal grooves directed at the open edge of the spring support portion with a depth along the inner surface of the liquid conducting portion are peripherally provided, or the liquid conducting portion is concentrically formed from the rear end of the telescope toward the vicinity of the spring support portion at the extreme end thereof, and a plurality of liquid conducting slits directed at the open edge of the spring support portion from the liquid conducting portion and opened toward the outer surface of the telescope are peripherally formed.

Further, a stopping shoulder having substantially the same diameter as the outside diameter of the coiled spring is provided on the spring support portion, and one end portion of the coiled spring is fixedly mounted and supported to the stopping shoulder by pressing or screwing.

Furthermore, according to the present invention, there is further provided a writing tool in which a tip embracing a rotary body in contact with an inwardly-directed extreme end edge in a state urged forward by means of a coiled spring to project a port thereof within a ball house within the extreme end is connected to a liquid tank, wherein said coiled spring is formed to be shorter than the tip, said coiled spring is concentrically supported at the extreme end of a telescope for fixedly inserting it into the tip and placed in spring contact with the rotary body, said telescope being formed to have a length from an opening at the rear end of the tip to the vicinity of the ball house at the extreme end thereof by a spring support tubular portion which is shorter than at least a length of the coiled spring and has a diameter larger than the outside diameter of the coiled spring and a partitioning portion integrally extended with a suitable thickness from the rear end side of the spring support tubular portion and a width which is substantially the same as the inside diameter of the tip, the telescope being pressed and inserted into the tip by the partitioning portion, and a liquid conducting portion extending from an opening at the rear end of the tip to the vicinity of the ball house at the extreme end thereof is secured between said partitioning portion and said spring support tubular portion, and the Inner surface of the tip.

Further there is integrally extended a tail end portion which is projected from the rear end of the partitioning portion located at the opening at the rear end of the tip toward the liquid tank side with the same thickness as that of at least said partitioning portion.

BRIEF DESCRIPTION OF THE DRAWINGS

FIG. 17 is a longitudinal sectional view showing one example of the using state for correcting erroneously written portions or the like;

DETAILED DESCRIPTION

Figure 1A:
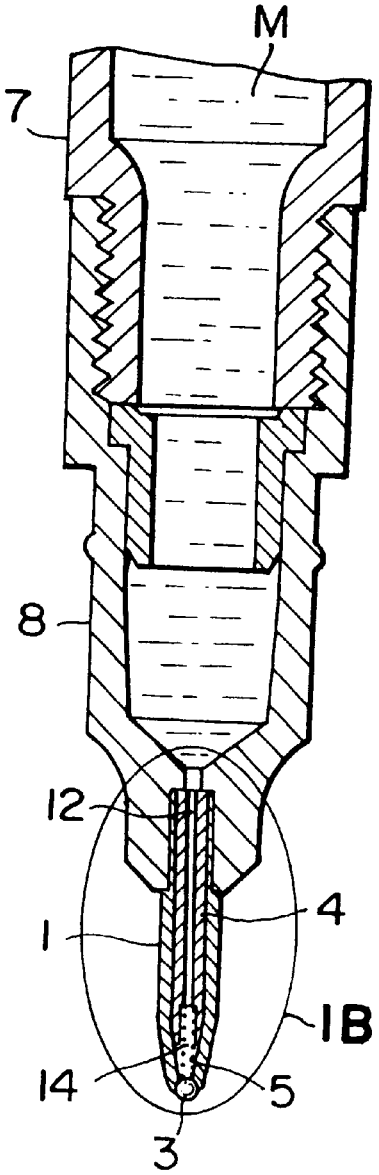
FIG. 1A is a longitudinal sectional view showing a first embodiment of writing tool according to the present invention.
Figure 1B:
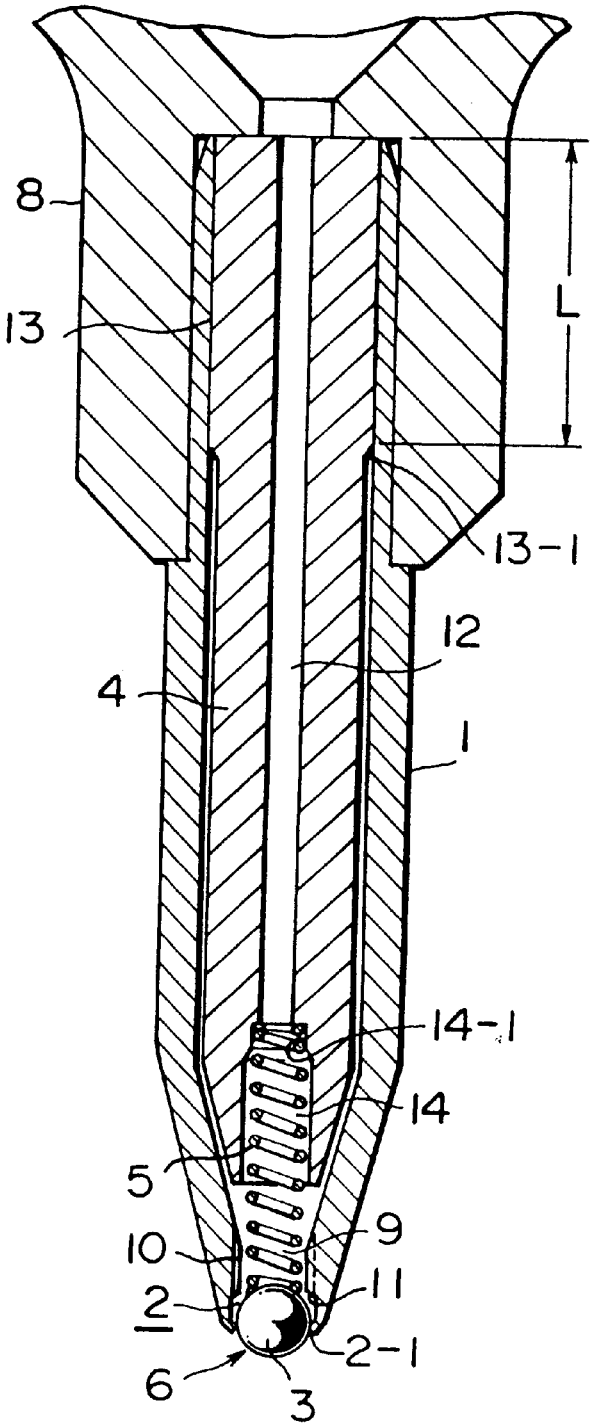
FIG. 1 is an enlarged view of I section of FIG. 1A.

The embodiments of the writing tool according to the present invention will be described hereinafter with reference to the accompanying drawings.

FIGS. 1A to 3 show a first embodiment of the writing tool of the present invention. A rotary body 3 is rotatably mounted within a ball house 2 at the extreme end of a tip 1. The rotary body 3 is urged forward by a coiled spring 5 supported by a tubular member 4, incorporated and arranged into contact with an inwardly directed extreme end edge 2-1 of the ball house 2 so that ink or an applying liquid M does not flow out of a liquid applying port 6. That is, the rotary body 3 and the inwardly directed extreme end edge 2-1 of the ball house 2 constitute a valve. When not in use, ink or an applying liquid M does not flow out of a liquid applying port 6, which is connected through a holder 8 to the extreme end of a liquid tank 7 of a pen type or a bottle type by pressing.

The tip 1 is formed from a metallic pipe or the like so that the extreme end converges. Within the extreme end is formed the ball house 2, defined by a seat portion 11 having a center liquid conducting hole 9 and a radial longitudinal groove 10. The rotary body 3 is rotatably mounted within the ball house 2. A tubular member 4 supports coiled spring 5 to urge the rotary body 3 in the direction of the inwardly directed extreme end edge 2-1 of the ball house 2 to induce spring contact with the extreme end edge 2-1.

The full length of coiled spring 5 is shorter than the length of the tip 1. For example, the coiled spring 5 is about ⅓ to ¼ the length of the tip 1. One end (rear end) thereof is concentrically supported on the extreme end of the tubular member 4 and inserted into the tip 1 while the other end (extreme end) thereof is projected loosely into the ball house 2. This places it in spring contact with the rotary body 3 so that the rotary body 3 is brought into contact with the inwardly directed extreme end edge 2-1 of the ball house 2.

The tubular member 4 is a resin molded article which concentrically supports the coiled spring 5 within the tip 1, and conducts ink or the applying liquid M from the liquid tank 7 to the vicinity of the ball house 2 in which the rotary body 3 at the extreme end of the tip 1 is mounted. The tubular member 4 has an outer diameter smaller than the inner diameter of the tip 1. The length from the opening at the rear end of the tip 1 to the vicinity of the seat portion 11 is provided with a liquid conducting portion 12 extending through the core in the form of a hole directed at the front and rear ends. Tubular member 4 has the shape of a rod with a shoulder provided with a large diameter fixed portion 13 secured by pressing into the tip 1 with a suitable range L in an axial direction from the rear end. A spring support portion 14 for supporting one end of the coiled spring 5 is concentrically provided on the extreme end side formed to adjust to the end shape of the tip 1.

The large diameter fixed portion 13 firmly and concentrically fixes the tubular member 4 within the tip 1. In other words, it firmly and concentrically fixes the coiled spring 5, which presses the rotary body 3 against the paper surface, within the tip 1. The large diameter fixed portion 13 has a diameter which is substantially the same as the inside diameter of the tip 1 within a suitable distance L in an axial direction from the rear end of the tubular member 4 and is firmly fixed within the tip 1 by spring compression so as to center the tubular member 4 with respect to the core of the tip 1.

Figure 2:
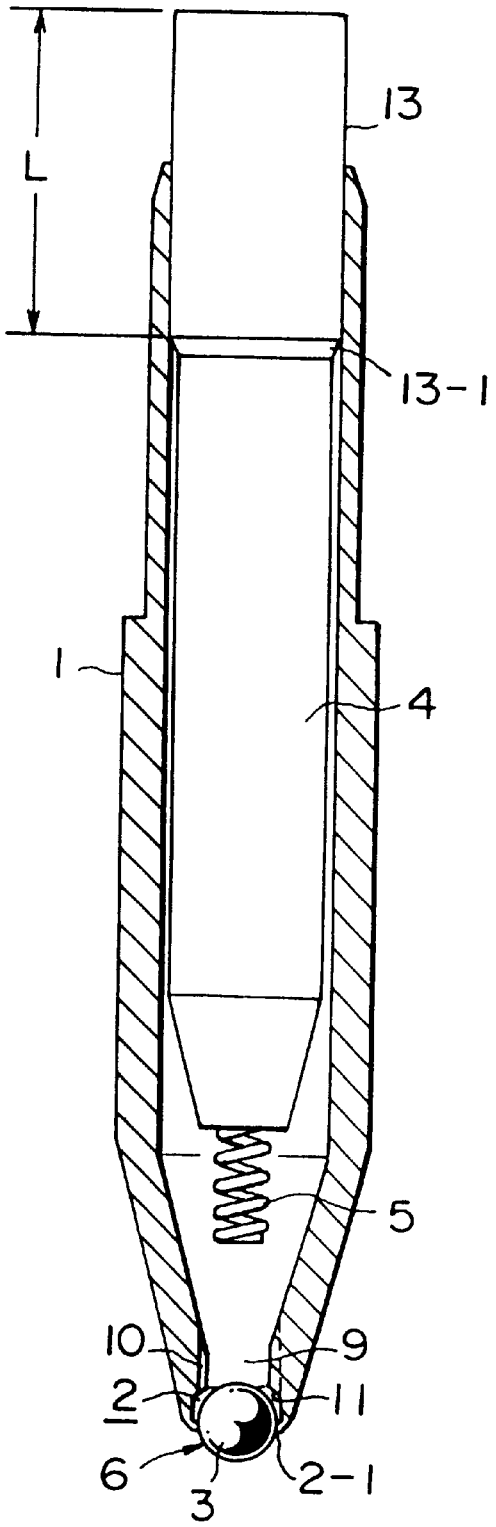
FIG. 2 is a longitudinal sectional view showing a process in which a coiled spring is incorporated into a tip.

The tubular member 4 is inserted within the tip 1 in a loosened state (in a non-contact state) with a slight clearance relative to the inner surface of the tip 1 (other than the large diameter fixed portion on the rear end side in a state of being incorporated within the tip 1). Therefore, it is possible to simply center the tubular member 4 with respect to the core of the tip 1. The large diameter fixed portion 13 is formed with a suitable distance L axially from the rear end. Therefore, when the tubular member 4 is incorporated into the tip 1 as shown in FIG. 2, the proximal end 13-1 of the shoulder of the large diameter fixed portion 13 is pressed into the opening at the rear end of the tip 1. At the same time, the tubular member 4 is centered on the core of the tip 1. That is, the tubular member 4 is pressed into the tip 1; and at the same time, on the other side of the coiled spring 5, the seat portion 11 of the ball house 2 is centered relative to the core of the liquid conducting hole so that the tubular member 4 can be loosely projected into the ball house 2 such that the coiled spring 5 is centered with respect to the core of liquid conducting hole 9. Thereby, in the process for incorporating the telescope 4 into the tip 1, the rear end of the coiled spring 5 does not impinge upon the liquid conducting hole 9, but the forward end of the coiled spring 5 projects into the ball house 2 into contact with the rotary body 3. This considerably simplifies the assembly of the coiled spring 5 into the tip 1 as compared with the prior art writing tool.

A spring support portion 14 is concentrically formed from the extreme end of the tubular member 4 with a hole diameter which is smaller than the length of the coiled spring 5 and larger than the outer diameter of the coiled spring 5. The hole bottom communicates with the liquid conducting portion 12, the coiled spring 5 being supported with one end loosely inserted therein. The hole bottom of the spring support portion 14 in communication with the liquid conducting portion 12 is provided with a stopping shoulder 14-1 having a diameter which is substantially the same as the outer diameter of the coiled spring 5. One end portion of the coiled spring 5 is loosely inserted in an immersed manner and supported by spring pressure.

The spring 5 is compressed and deformed according to a degree of writing pressure when the rotary body 3 is pressed against the paper surface and the writing pressure is released, such that the coiled spring 5 is not impeded in its expansion and deformation. Since the coiled spring 5 is firmly secured to and supported on the stopping shoulder 14-1, the coiled spring 5 does not deviate from the core of the tip 1, but rather causes the rotary body 3 to evenly contact the inwardly directed extreme end edge 2-1 (the entire periphery of the edge) of the ball house 2 in a well balanced manner to close the valve. This prevents leakage of ink or the applying liquid M.

Figure 3:
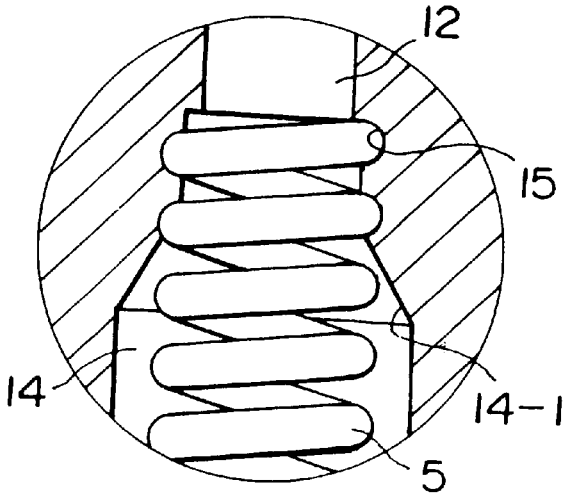
FIG. 3 is an portly enlarged view showing further embodiment of a supporting model 3 of the coiled spring with respect to a spring support portion.

The fixing element that supports one end of the coiled spring 5 to the stopping shoulder 14-1 of the spring support portion 14 is not limited to the above. Various other structures may be used. By way of example, as shown in FIG. 3, the stopping shoulder 14-1 is provided with a helical groove 15 so that several winds on one end side of the coiled spring 5 screw therein for support.

According to the writing tool described in detail in the first embodiment, the assembly is reduced as compared with the lengthy coiled spring of the conventional writing tool as for as the length of the coiled spring 5 is shortened about ⅓ to ¼ of the length of the tip 1. This reduces the manufacturing costs of coiled spring 5. In addition, since the ink or the applying liquid within the liquid tank is supplied to the ball house at the extreme end of the tip passing through the liquid conducting portion leading to the front and rear ends of the tubular member 4, the flow of the ink or the applying liquid M within the liquid tank 7 supplied to the ball house 2 is less impeded as compared with the tip construction of the prior art writing tool. Thereby, the ink or the applying liquid can be supplied to the ball house quickly.

When the coiled spring 5 is incorporated into and mounted in the tip 1, the coiled spring 5 together with the tubular member 4 can be inserted into the tip 1 such that one end of the coiled spring 5 is loosely inserted into a coil support portion of the tubular member 4. The liquid conducting portion 12 extends through toward the spring support portion 14 at the extreme end on the core, in the length from the opening at the rear end of the tip 1 to the vicinity of the ball house 2 at the extreme end. The large diameter fixed portion 13 is fixedly inserted by pressing into the tip 1 on the rear end side. The one end side thereof is firmly secured to and supported on the stopping shoulder 14-1. Therefore, it is possible to simply insert and center the coiled spring 5 within the tip 1. That is, the coiled spring 5 can be loosely projected toward the ball house 2 and placed in (spring) contact with the rotary body 3 such that the coiled spring 5 is centered with the core of the liquid conducting hole 9 in the center of the seat portion 11 of the ball house 2 at the extreme end of the tip 1 without deviation from the core. This provides for the closed valve to prevent leakage of ink or the applying liquid M, as described above.

The ink or the applying liquid M within the liquid tank 7 is guided to the vicinity of the ball house 2 through the liquid conducting portion 12 of the core of the tubular member 4, from the rear end of the tip 1 to the vicinity of the ball house 2 at the extreme end thereof and the spring support portion 14 in communication with the liquid conducting portion 12 and fed to the ball house 2. Therefore, no liquid run-out occurs during the use as in the prior art writing tool.

Further, since the tubular member 4 is fixedly incorporated into the tip 1, it is simpler to center the tubular member 4 with respect to the core of the tip 1 than fixedly incorporating the entire outer surface of the tubular member 4 in contact with the inner surface of the tip 1. Thereby, the numbering of processing steps is reduced, thus reducing the manufacturing cost.

Figure 4:
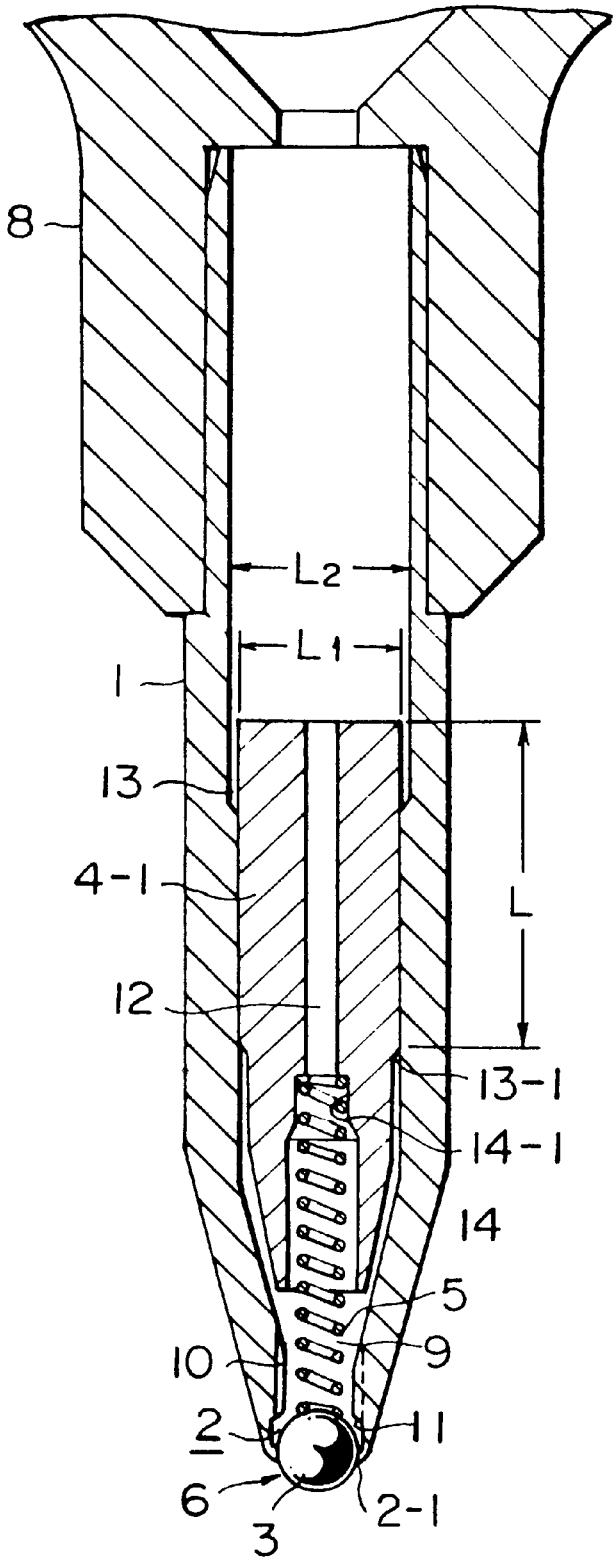
FIG. 4 is a longitudinal sectional view showing a further modification.

FIG. 4 shows a modification in which the length of the tubular member 4-1 is shortened as a whole. The hole shape of the tip 1 is formed with a shoulder so that the large diameter fixed portion 13 of the tubular member 4-1 can be pressed and fixed at the extreme end side. Since this modification is basically the same as the first embodiment described above except that the length of the tubular member 4-1 and the hole shape of the tip 1 in the writing tool described in the first embodiment are changed, the description thereof is omitted, and the same reference numerals are used for the same constituent parts.

The tubular member 4-1 has a length formed with the large diameter fixed portion 13 in the above-described range of length L in the outer periphery thereof except the extreme end having the spring support portion 14. For example, the tubular member 4-1 is short about ⅓ of the length of the tubular member 4. On the other hand, the tip 1 has a diameter $L_1$ on the extreme end side thereof formed so that the large diameter fixed portion 13 of the tubular member 4-1 can be fixed by pressing, and has a diameter $L_2$, from the part on the extreme end to the opening at the rear end formed into a hole with a shoulder through which the large diameter fixed portion 13 can pass in a loosened state.

Figure 5A:
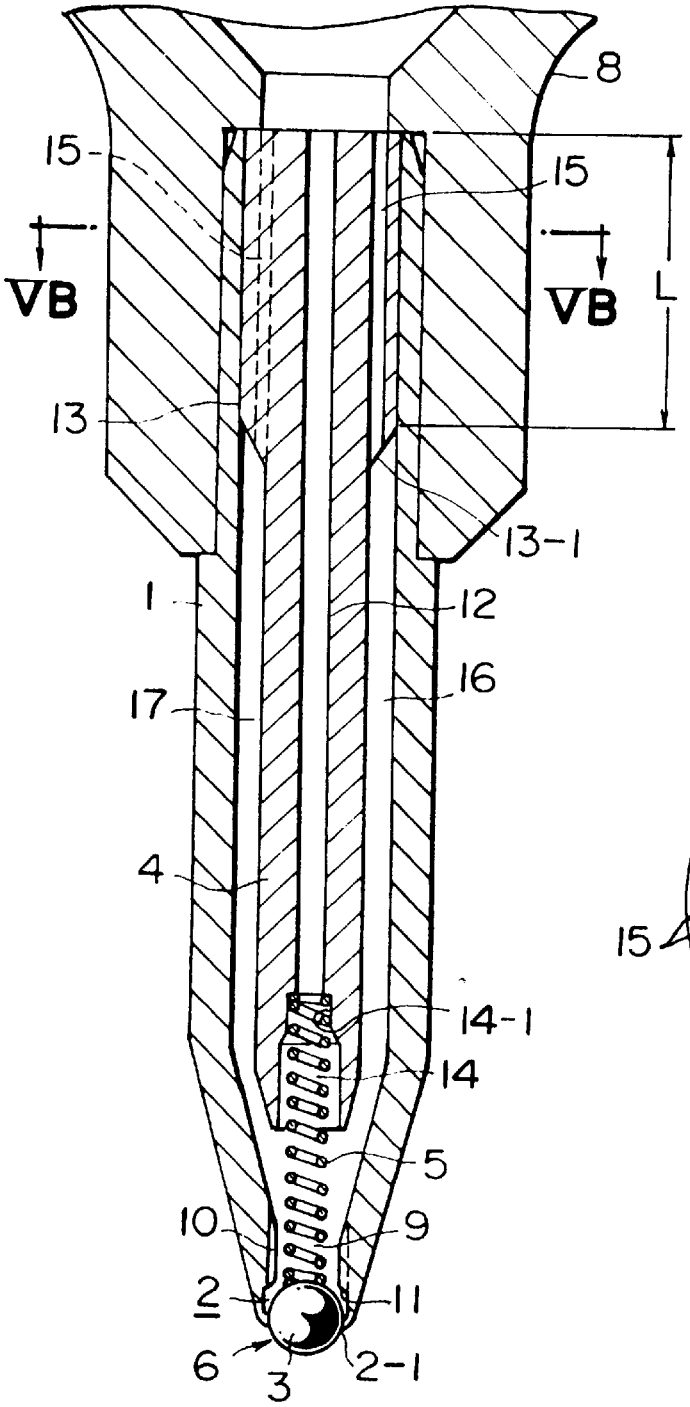
FIG. 5A is a longitudinal sectional view showing a second embodiment of writing tool according to the present invention.
Figure 5B:
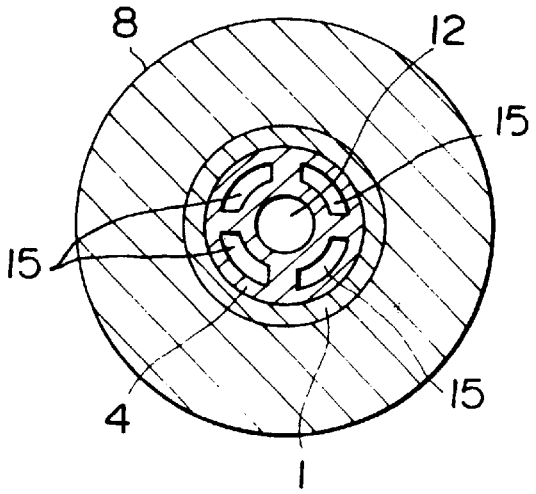
FIG. 5B is a cross sectional view taken on line V.—V. of FIG. 5A.

FIGS. 5A and 5B show a second embodiment of the writing tool of the present invention, wherein the large diameter fixed portion 13 of the tubular member 4 is provided with a liquid flowing hole 15 extending through from the rear end thereof toward a shoulder proximal end 13-1. Another diameter (outside diameter) of the tubular member 4 extends from the shoulder proximal end 13-1 to the open edge of the spring support portion 14 is smaller than the inner diameter of the tip 1. This secures a second liquid conducting portion 16 for guiding ink or an applying liquid M through the liquid flowing hole 15 toward the vicinity of the seat portion 11 of the ball house 2 in the inner surface of the tip 1 from the shoulder proximal end 13-1 of the large diameter fixed portion 13 to the open edge of the spring support portion 14. As described above, since the second embodiment is basically the same in construction as that of the first embodiment described in detail, except that the large diameter fixed portion 13 is provided with a liquid flowing hole 15, and the diameter of the tubular member 4 extending from the proximal end shoulder 13-1 of the large diameter fixed portion 13 to the open edge of the spring support portion 14 is smaller, the description thereof is omitted, and the same reference numerals are used for the same constituent parts.

In the second embodiment, the outer diameter of the tubular member 4 in the range from the proximal end shoulder 13-1 of the large diameter fixed portion 13 is smaller, by two or three times, from the inner diameter of the tip 1. A small diameter loose portion 17 loosely present in the tip 1 is provided to secure a second liquid conducting portion 16, having an open sectional area through which ink or an applying liquid M can pass quickly, in the inner surface of the tip 1. A plurality of liquid flowing holes 15 are peripherally provided (see FIG. 5B) which extend through in a suitable open shape from the proximal end shoulder 13-1 of the large diameter fixed portion 13 relative to the small diameter loose portion 17 toward the rear end of the tubular member 4 thereof.

According to the writing tool described in detail in the second embodiment, by fixedly inserting the tubular member 4 into the tip 1, the second liquid conducting portion 16 has an open sectional area through which ink or an applying liquid M passes between the small diameter loose portion 17 from the shoulder proximal end 13-1 of the large 28 diameter fixed portion 13 to the open edge of the spring support portion 14 at the extreme end of the tubular member 4. Thereby, the ink or the applying liquid M within the liquid tank 7 passes through the liquid conducting portion 12 leading to the spring support portion 14 of the core of the tubular member 4 for supporting the coiled spring 5 in an immersed state, each of the liquid flowing holes 15 from the rear end of the tubular member 4 to the shoulder proximal end 13-1 of the large diameter fixed portion 13, and is guided to the vicinity of the ball house 2 to pass through the second liquid conducting portion 16 secured relative to the Inner surface of the tip 1. It is therefore possible to supply the ink or the applying liquid M to the ball house 2 quickly.

Preferably, the tubular member 4 described in detail in the second embodiment can be as short as shown in FIG. 4 and fixedly inserted into the extreme end of the tip 1.

Figure 6A:
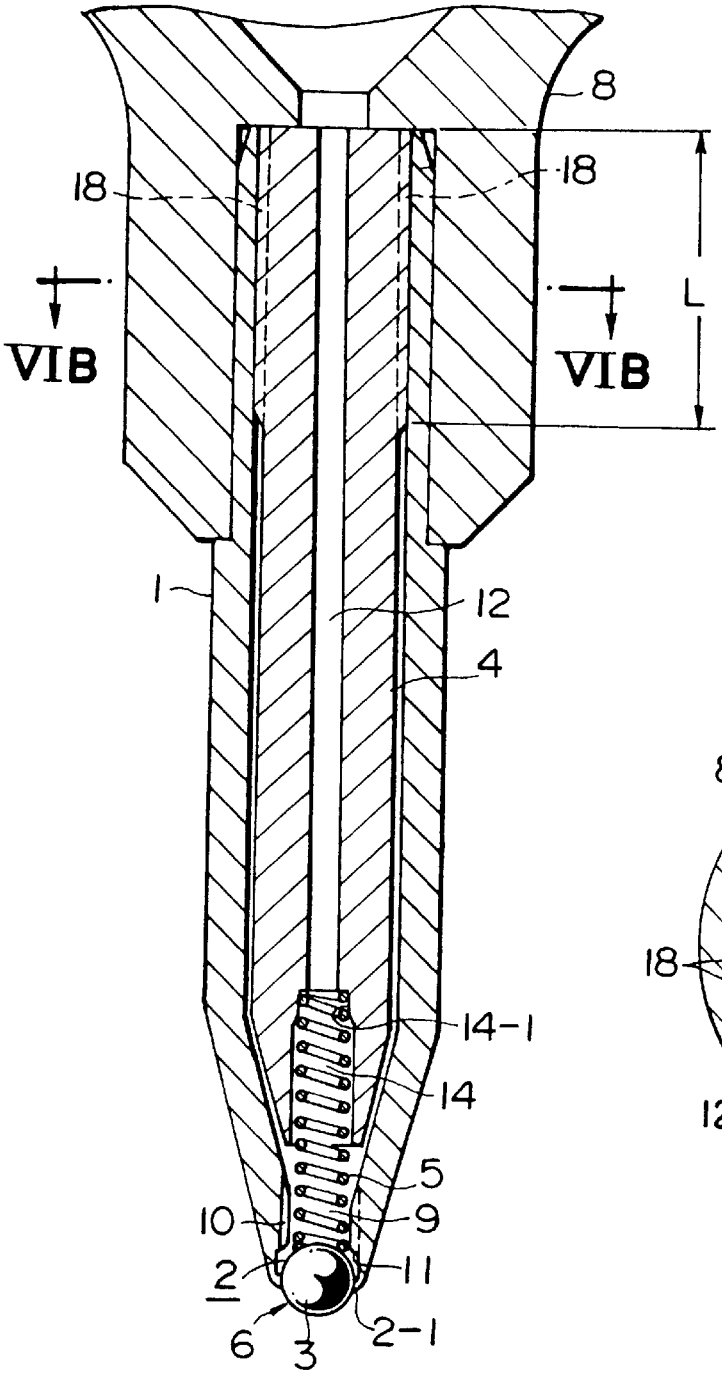
FIG. 6A is a longitudinal sectional view showing a third embodiment of writing tool according to the present invention.
Figure 6B:
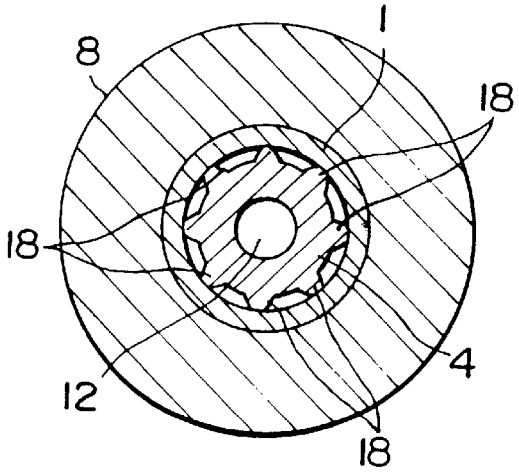
FIG. 6B is a cross sectional view taken on line VAB—VAB of FIG. 6A.

FIGS. 6A and 6B show a third embodiment of the writing tool of the present invention wherein a plurality of fixed longitudinal ribs 18 project at a projecting height, having substantially the same diameter as the inner diameter of the tip 1 (described in detail in the aforementioned first embodiment) are provided on the rear end side of the tubular member 4. The fixed longitudinal ribs 18 are pressed into the tip 1 to fixedly insert the tubular member 4 into the tip 1. Since the third embodiment is basically the same in construction as that of the first embodiment described in detail except that the fixed longitudinal ribs 18 are provided on the rear end side of the tubular member 4 in place of the large diameter fixed portion 13 secured into the tip 1 by pressing in the writing tool described in the first embodiment, the description thereof is omitted, and the same reference numerals are used for the same constituent parts.

The fixed longitudinal ribs 18 press the tubular member 4 into the tip 1 (similar to the large diameter fixed portion 13) to thereby firmly and concentrically fix it thereto. A plurality of such ribs are peripherally provided on the rear end side of the tubular member 4 at a projecting height having substantially the same diameter as the inner diameter of the tip 1 within the suitable distance L axially from the rear end of the tubular member 4. Such ribs are provided at three to eight locations as shown in FIG. 6*b*, positioned peripherally equidistantly and pressed against the inner surface of the tip 1 at three to eight-point peripheral supports to firmly fix the tubular member 4 within the tip 1.

According to the writing tool described in detail in the third embodiment, when the tubular member 4 is inserted into the tip 1, the telescope 4 is fixedly inserted into the tip 1 such that the fixed longitudinal ribs 18 provided on the rear end side are pressed against the inner surface of the tip 1 in axial line contact. It is therefore easier to center the tubular member 4 with respect to the core of the tip 1 than in the first and second embodiments. In other words, compared with the construction in the first and second embodiments, the tubular member 4 can be centered relative to the core of the tip 1 with minimal effect by the precision of the surface finish, such as the inner surface finish of the tip 1 of a portion (range of distance L), in which the tubular member 4 is fixedly pressed. Thereby, the outer surface finish of the tubular member 4 for centering is not necessary, and the inner surface finish of the tip 1 will suffice to be rough. Therefore, the number of process steps for the surface finish can be further reduced as compared with the first and second embodiments. In addition, manufacturing costs are further reduced.

Figure 7A:
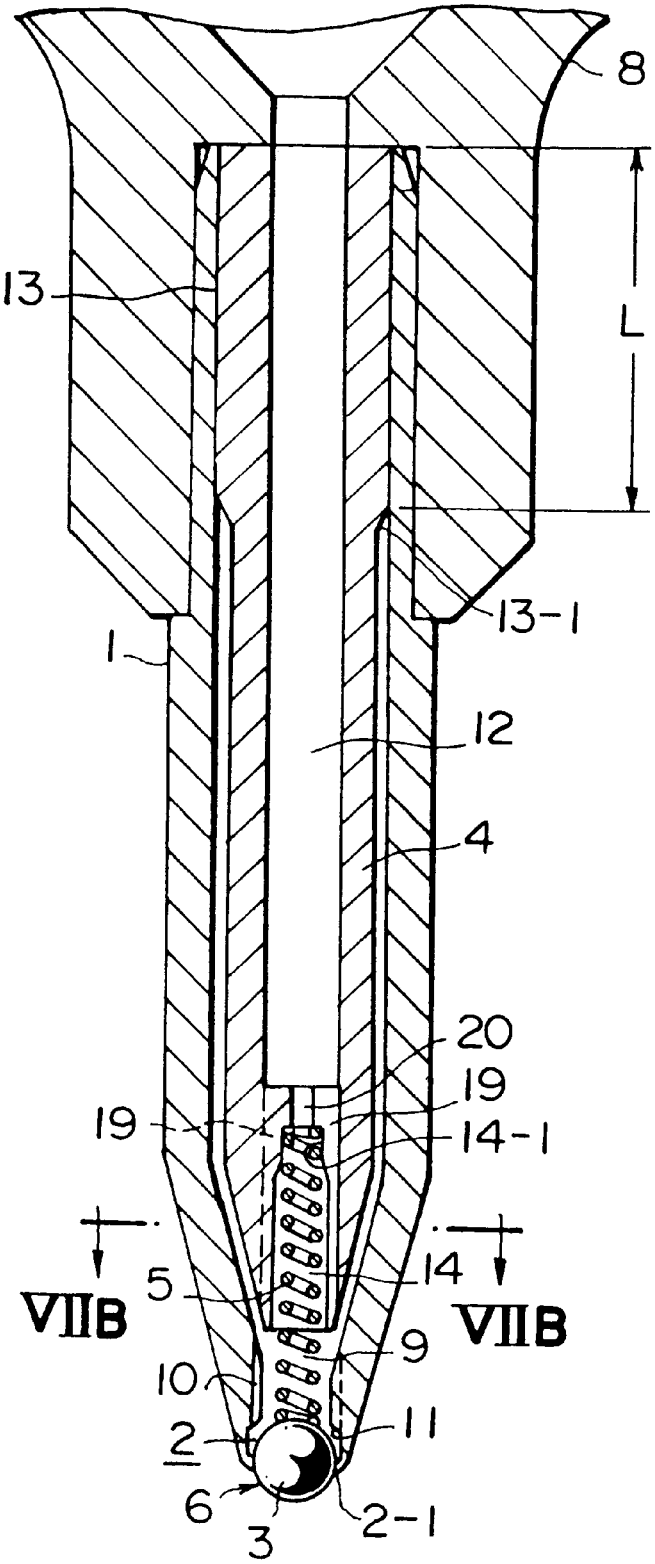
FIG. 7A is a longitudinal sectional view showing a fourth embodiment of writing tool according to the present invention.
Figure 7B:
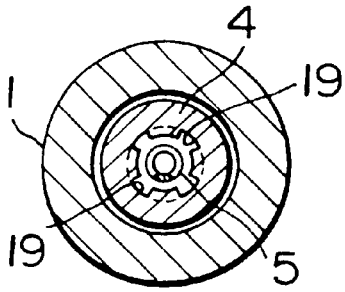
FIG. 7B is a cross sectional view taken on line VII—VII of FIG. 7A.

FIGS. 7A and 7B show a fourth embodiment of the writing tool of the present invention. The open configuration of the spring support portion 14 in communication with the liquid conducting portion 12 of the tubular member 4 is changed. A liquid conducting longitudinal groove 19 is provided from the liquid conducting portion 12 toward the open edge of the spring support portion 14 so that ink or applying liquid is supplied from the liquid conducting portion 12 to the ball house 2 at the extreme end with minimal flow resistance. Since the fourth embodiment is basically the same in construction as that of the first embodiment except that the open configuration of the spring support portion 14 from the liquid conducting portion 12 to the open edge and the liquid conducting longitudinal groove 19, the description thereof is omitted, and the same reference numerals are used for the same constituent parts.

The spring support portion 14 is concentrically provided, from the extreme end of the tubular member 4 toward the vicinity of the liquid conducting portion 12, with a diameter smaller than that of the liquid conducting portion 12, and a small diameter portion 20 having a smaller diameter than the first mentioned diameter is concentrically provided toward the liquid conducting portion 12 into communication with the latter. A liquid conducting longitudinal groove 19 is provided from the communication proximal end of the liquid conducting portion 12 with the small diameter portion 20 toward the open edge of the spring support portion 14.

The liquid conducting longitudinal groove 19 quickly guides ink or an applying liquid M under the capillary action from the liquid conducting portion 12 toward the open edge of the spring support portion 14, several of which are peripherally provided from the communication proximal end of the liquid conducting portion 12 with the small diameter portion 20 with a depth along the inner surface of the liquid conducting portion 12 (see FIG. 7B).

According to the writing tool described in detail in the fourth embodiment, the liquid conducting longitudinal groove 19 is provided from the communication proximal end of the liquid conducting portion of the tubular member 4 core with the small diameter portion toward the open edge of the spring support portion 14. With this configuration, ink or an applying liquid flows from the liquid tank 7 to the communication proximal end through the liquid conducting portion 12 of the tubular member 4 from the small diameter portion 20 into the spring support portion 14, and is guided to the vicinity of the ball house 2 at the extreme end of the tip 1 under the capillary acting on the liquid conducting longitudinal groove 19 from the communication proximal end so that the ink is supplied to the ball house 2 quickly. That is, the ink or applying liquid flows from the communication proximal end through the liquid conducting portion 12 to the vicinity of the ball house 2 at the extreme end of the tip 1 under the capillary acting on the liquid conducting longitudinal groove 19 without flow resistance caused by the coiled spring 5. With this configuration, the ink or applying liquid can be quickly supplied to the ball house 2 without the flow being impeded by the coiled spring 5.

Preferably, the tubular member 4 described in detail in the forth embodiment is formed to be short as shown in FIG. 4 and fixedly inserted into the extreme end of the tip 1.

Figure 8A:
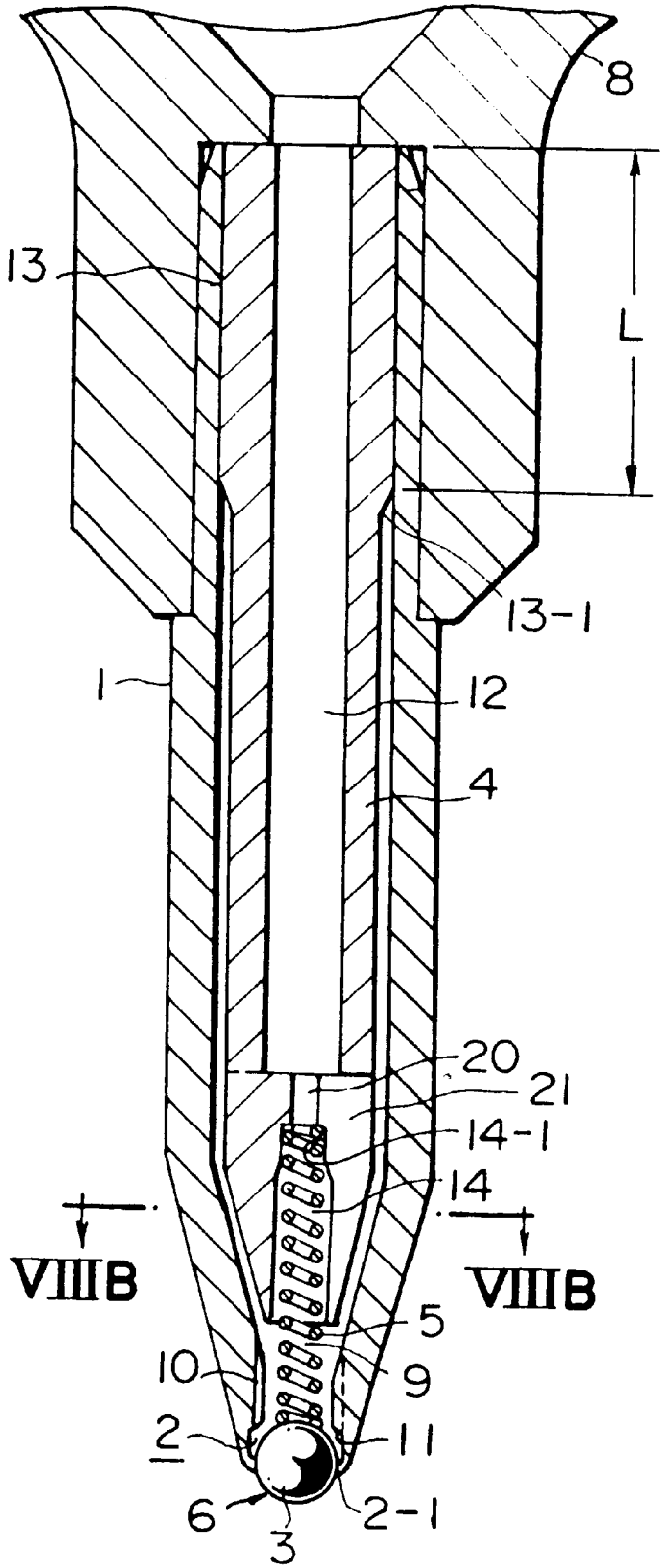
FIG. 8A is a longitudinal sectional view showing a fifth embodiment of writing tool according to the present invention.
Figure 8B:
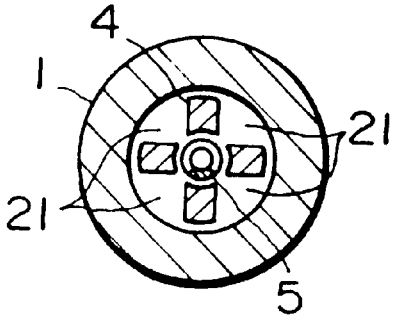
FIG. 8B is a cross sectional view taken on line VIII—VIII of FIG. 8A.

FIGS. 8A and 8B show a fifth embodiment of the writing tool of the present invention. In place of the liquid conducting longitudinal groove 19 described in detail in the fourth embodiment, there is provided a liquid conducting slit 21 which is open from the communication proximal end toward the open edge of the spring support portion 14 and toward the outer surface of the tubular member 4. Since the fifth embodiment is basically the same in construction as that of the fourth embodiment described in detail except that the liquid conducting slit 21 is provided, the description thereof is omitted, and the same reference numerals are used for the same constituent parts.

A plurality of liquid conducting slits 21, which are opened from the communication proximal end with the small diameter portion 20 of the liquid conducting portion 12 toward the open edge of the spring support portion 14 and toward the outer surface of the telescope, are peripherally provided with a suitable open shape (open area) (see FIG. 8B).

According to the writing tool described in detail in the fifth embodiment, ink or an applying liquid M from the liquid tank 7 passes through the liquid conducting portion 12 of the tubular member 4 core, to the liquid conducting slit 21, and to the vicinity of the ball house 2 in which the rotary body 3 at the extreme end of the tip 1 is mounted. That is, the ink or the applying liquid M having flown through the liquid conducting portion 12 of the tubular member 4 core is guided to the vicinity of the ball house 2 by passing through the liquid conducting slit 21, which is enlarged in its open sectional area, without being impeded in flow by the coiled spring 5. The ink is thus supplied to the ball house 2 quickly.

Preferably, the tubular member 4 described in detail in the fifth embodiment is likewise formed to be short as shown in FIG. 4 and fixedly inserted into the extreme end of the tip 1.

Figure 9A:
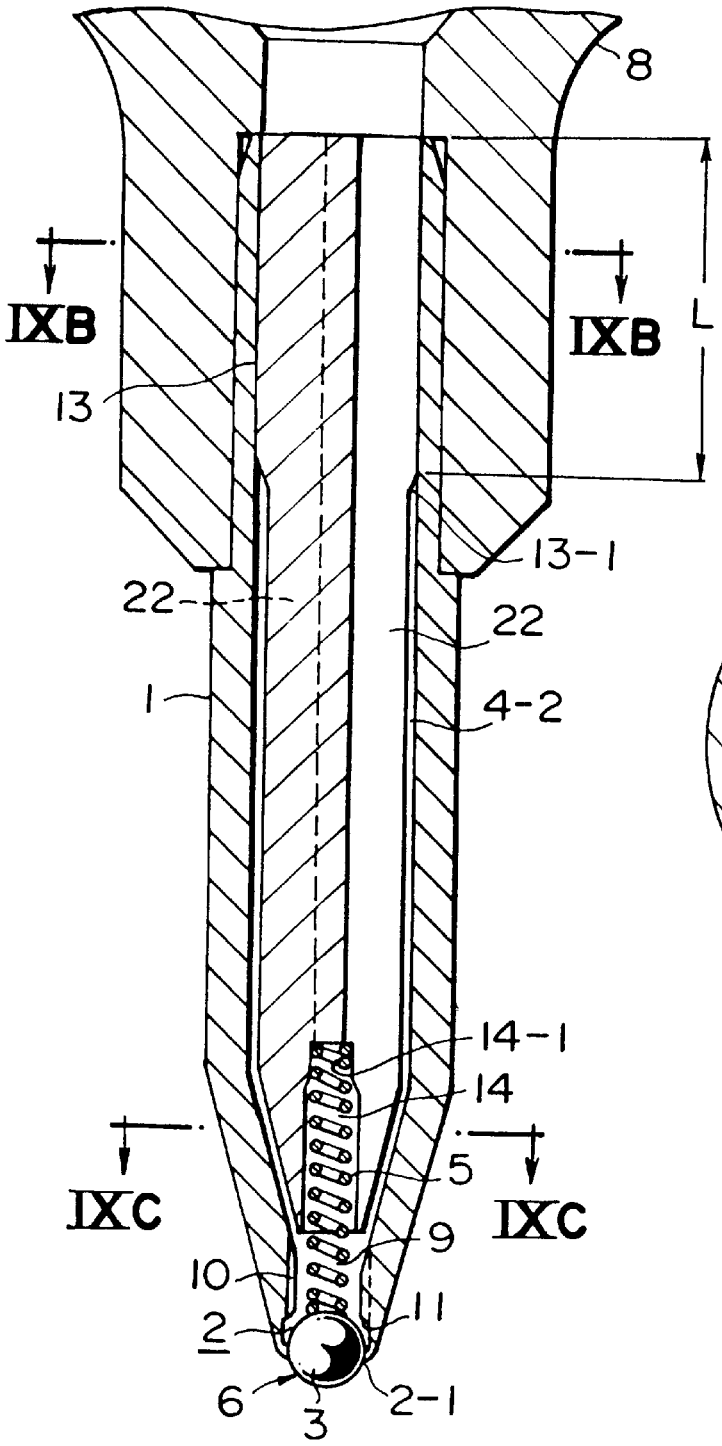
FIG. 9A is a longitudinal sectional view showing sixth embodiment of writing tool according to the present invention.
Figure 9B:
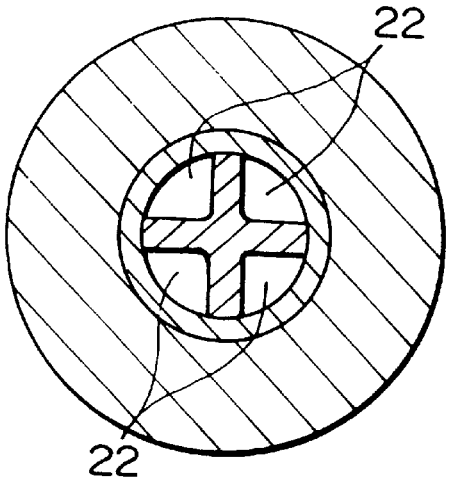
FIG. 9B is a cross sectional view taken on line I.–IB. of FIG. 9A.
Figure 9C:
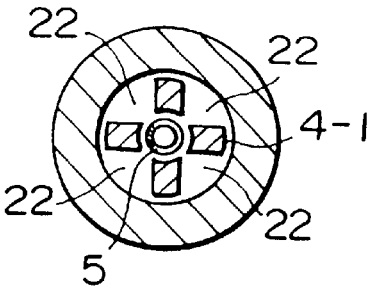
FIG. 9C is a cross sectional view taken on line IC—IC of FIG. 9A.

FIGS. 9A, 9B and 9C show a sixth embodiment of the writing tool of the present invention. As described in detail in the first embodiment, a groove-like liquid conducting portion 22 leading to the front and rear portions is provided in the outer surface of the tubular member 4-2, and ink or an applying liquid M in the liquid tank is supplied to the ball house 2 quickly passing through the groove-like liquid conducting portion 22 from the rear end of the tip 1 to the vicinity of the seat portion 11 of the ball house 2 at the extreme end. Since the sixth embodiment is basically the same in construction as that of the first embodiment described in detail except that the opening configuration of the liquid conducting portion 22 with respect to the tubular member 4-2 is changed, the description thereof is omitted, and the same reference numerals are used for the same constituent parts.

Several groove-like liquid conducting portions 22 are peripherally provided on the outer surface with a suitable open shape communicating with the spring support portion 14 from the peripheral surface thereof from the rear end of the tubular member 4-2 toward the converged extreme end, i.e., the open edge of the spring support portion 14 (see FIGS. 9B and 9C). The ink or the applying liquid M in the liquid tank 7 is guided to the vicinity of the seat portion 11 of the ball house 2 at the extreme end of the tip 1, and is supplied to the ball house 2.

According to the writing tool described In detail in the sixth embodiment, compared with the hole-like liquid conducting portion 12 described in detail in the first to fifth embodiments, the groove-like opened liquid conducting portion 22 provides a communication opening sectional area for feeding ink or an applying liquid M toward the ball house 2 at the extreme end of the tip 1. Thereby, this can cope with the flowability of the ink or the applying liquid M which differs with the physical properties such as viscosity, surface tension or specific gravity, etc. Accordingly, the ink or the applying liquid M having the varying physical properties according to the purpose of using the writing tool can be quickly supplied to the ball house 2 at the extreme end of the tip 1.

Figure 10A:
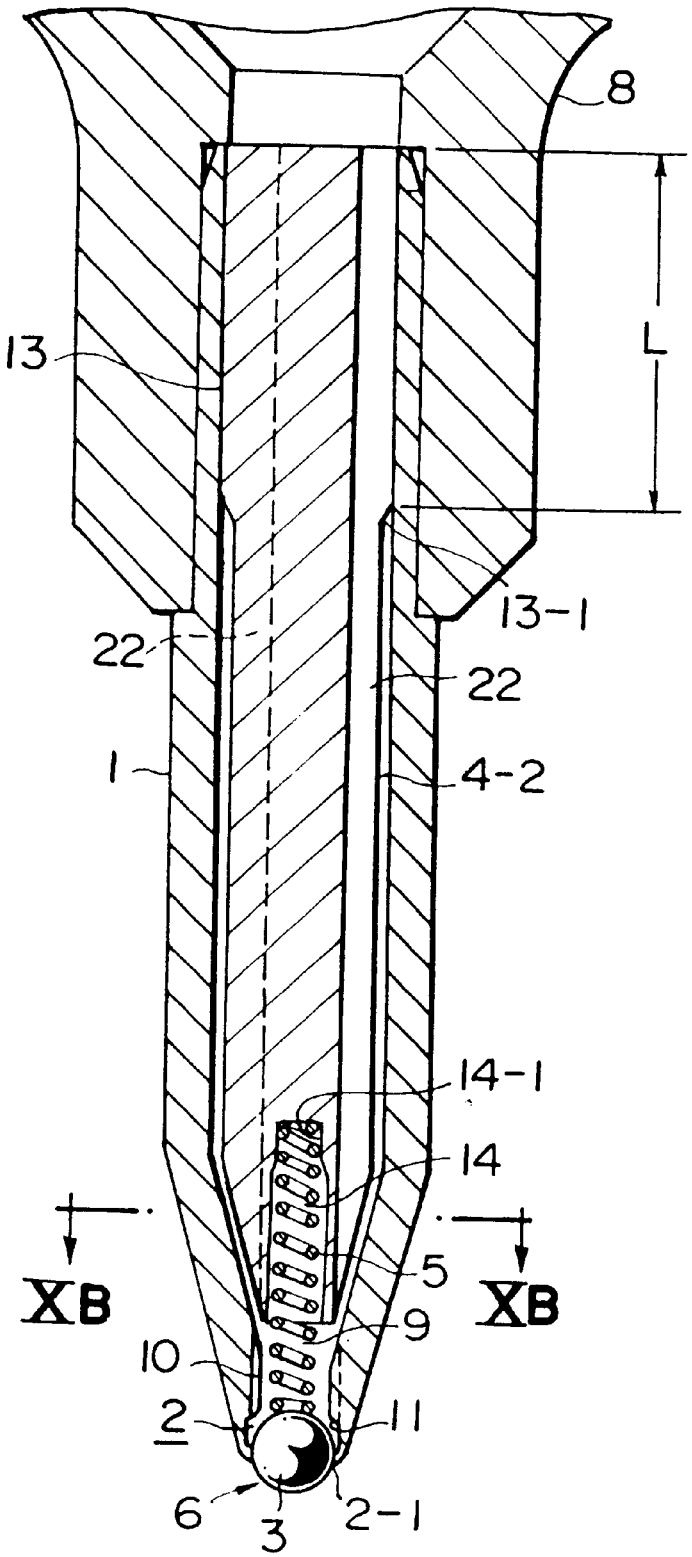
FIG. 10A is a longitudinal sectional view of main ports showing another embodiment.
Figure 10B:
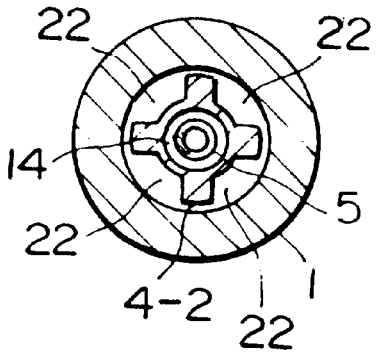
FIG. 10B is a cross sectional view taken on line X.—X. of FIG. 10A.
Figure 11A:
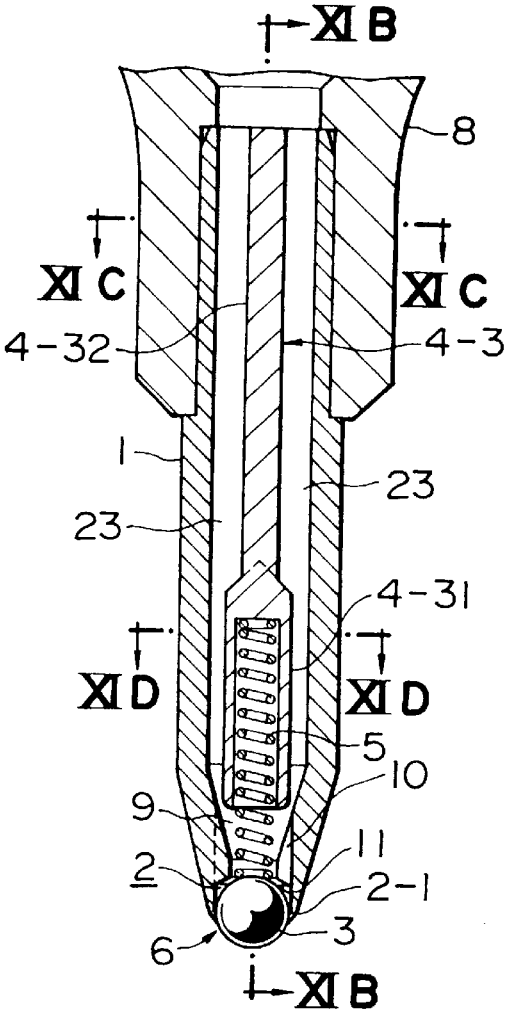
FIG. 11A is a longitudinal sectional view showing a seventh embodiment of writing tool according to the present invention.
Figure 11B:
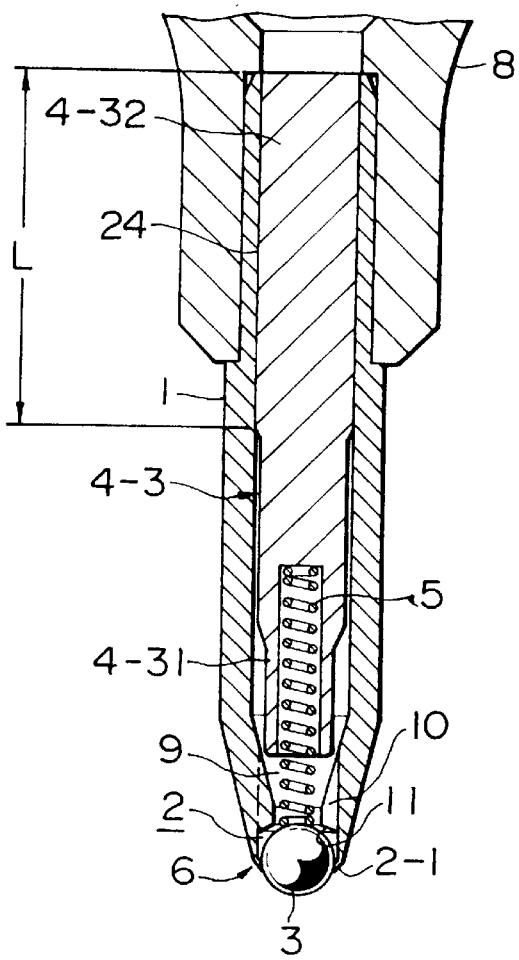
FIG. 11B is a cross sectional view taken on line XI—XI of FIG. 11A.
Figure 11C:
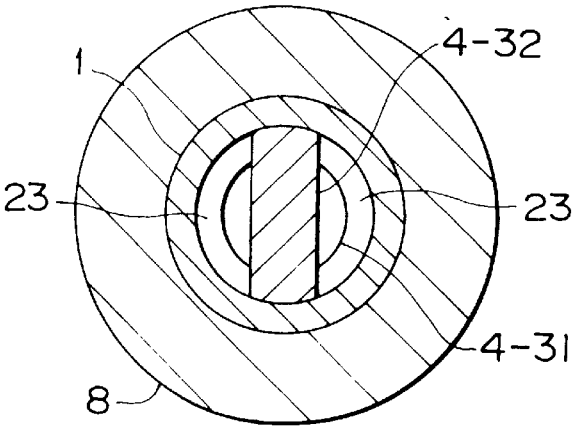
FIG. 11C is a cross sectional view taken on line XI—XI of FIG. 11A.
Figure 11D:
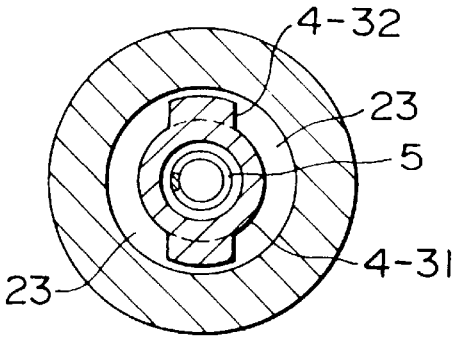
FIG. 11D is a cross sectional view taken on line X'D—X'D of FIG. I.A.
Figure 12A:
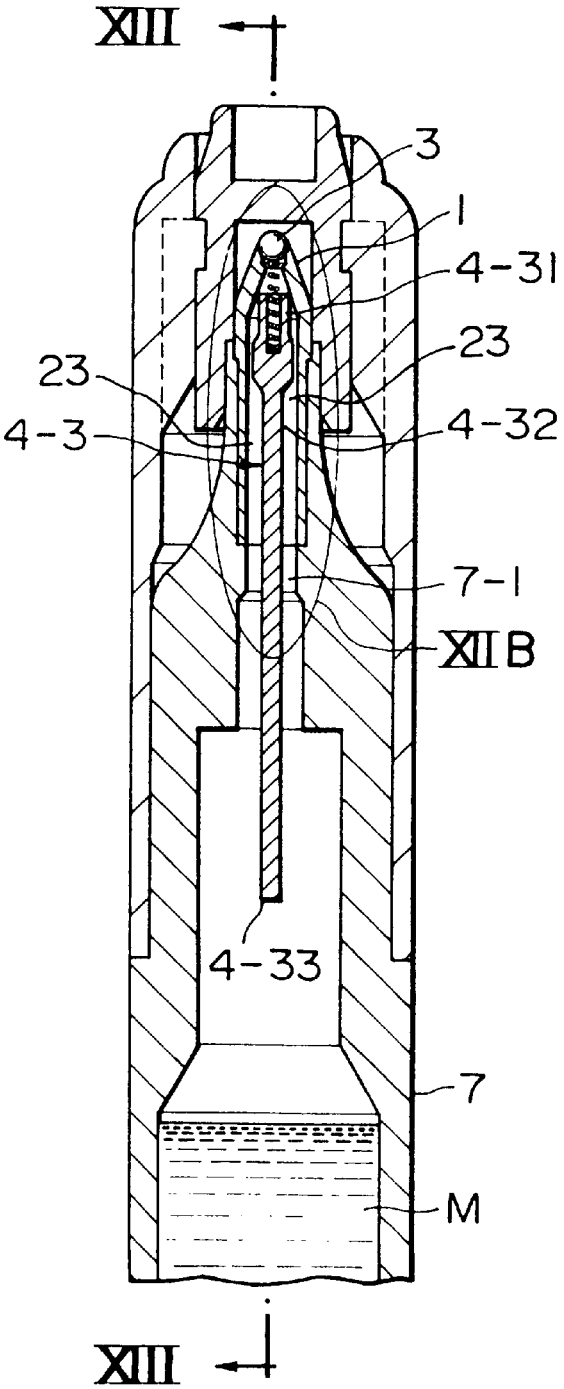
FIG. 12A is a longitudinal sectional view showing a eighth embodiment of writing tool according to the present invention.
Figure 12B:
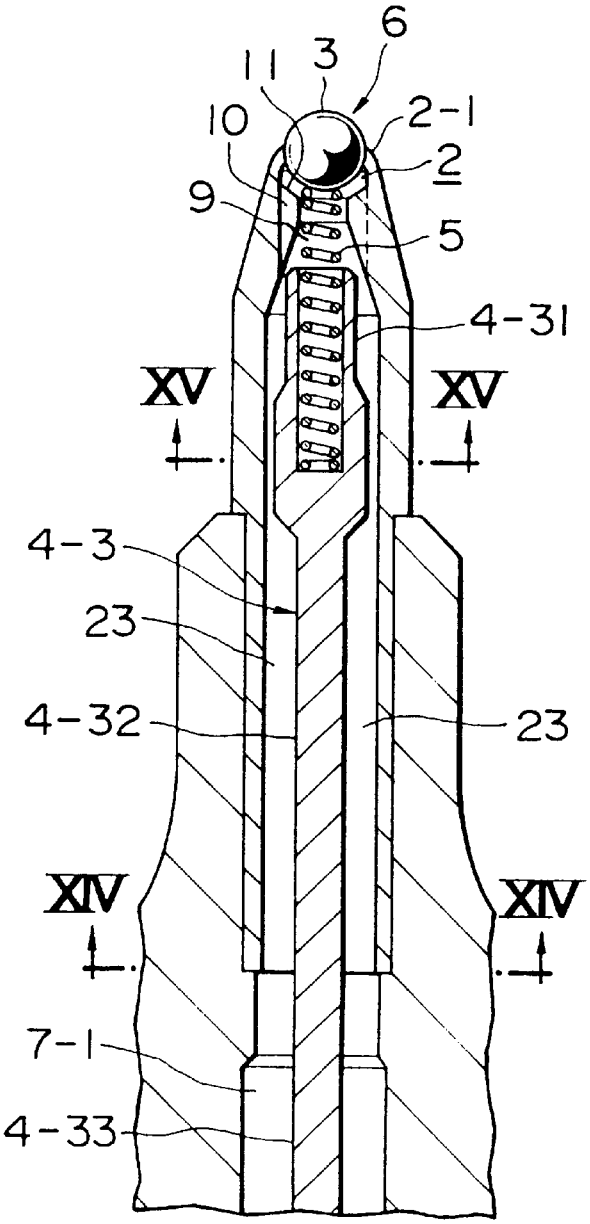
FIG. 12B is an enlarged view of XII of FIG. 12A.
Figure 13A:
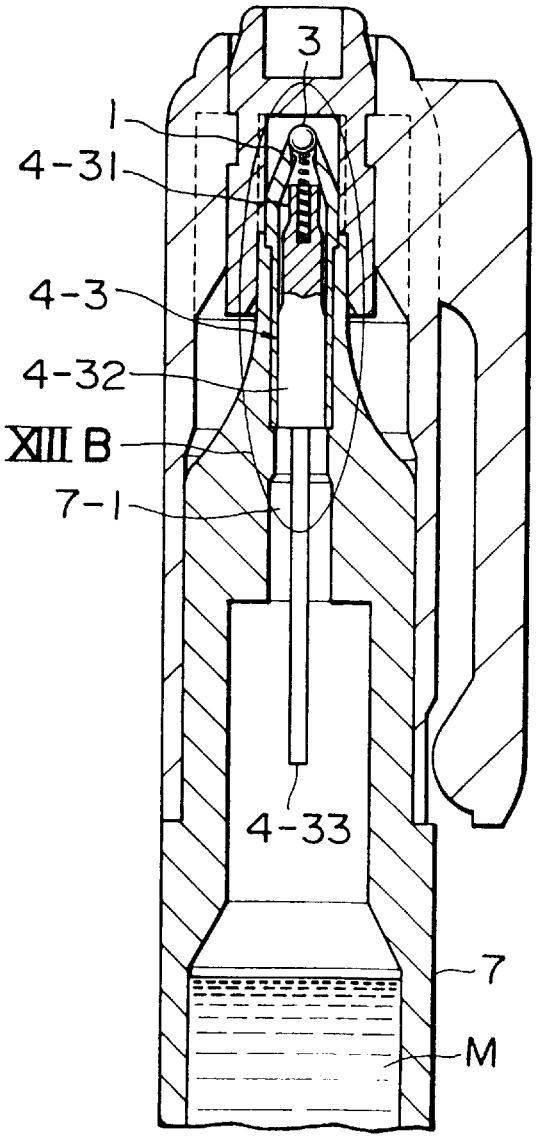
FIG. 13A is a longitudinal sectional view taken on line XIII—XIII of FIG. 12A.
Figure 13B:
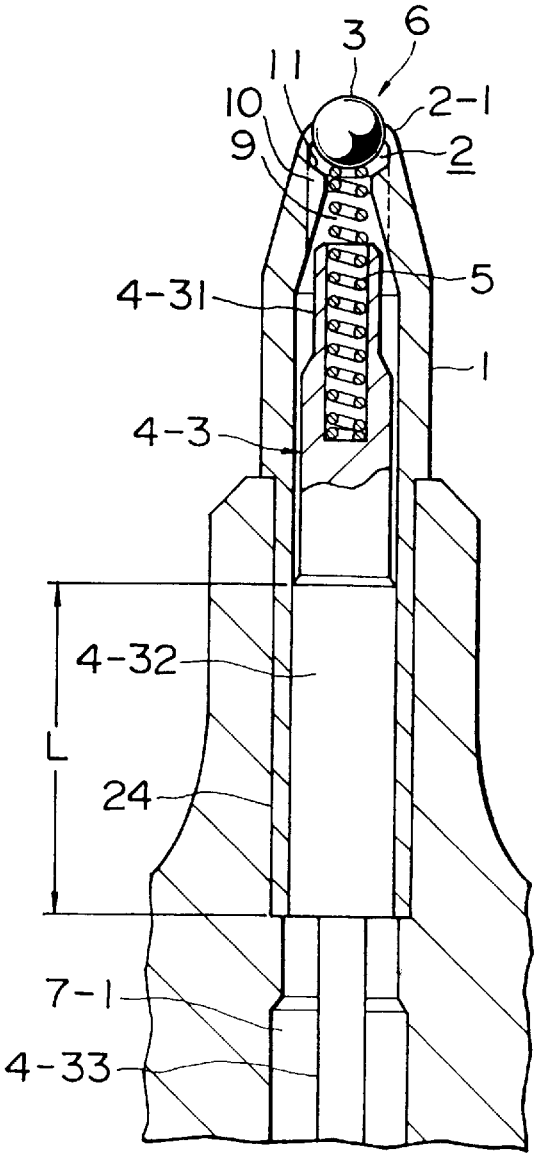
FIG. 13B is an enlarged view of XIII section of FIG. 13A.
Figure 14:
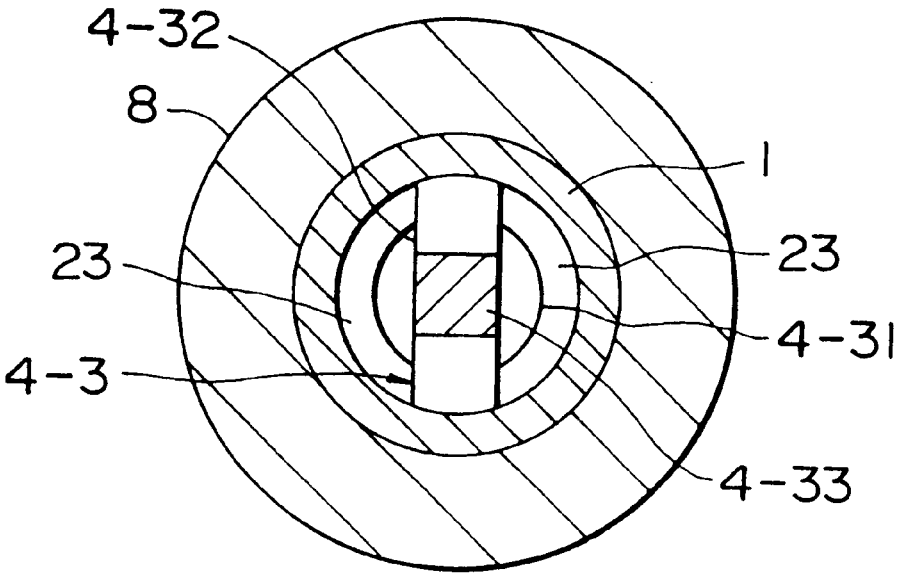
FIG. 14 is an enlarged cross sectional view taken on line XIV—XIV of FIG. 12B.
Figure 15:
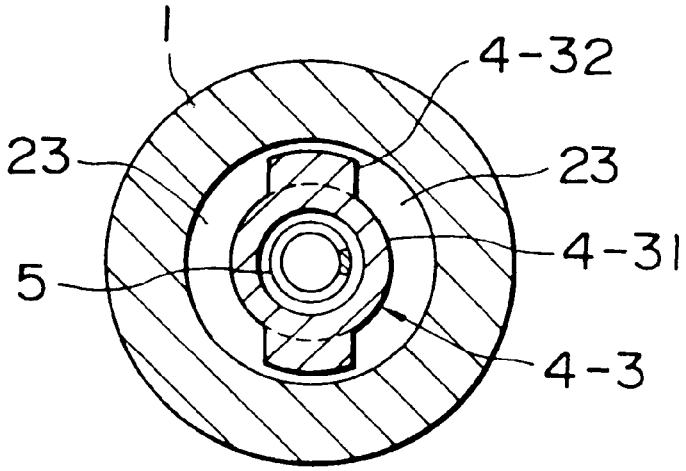
FIG. 15 is an enlarged cross sectional view taken on line XV—XV of FIG. 12B.

Preferably, the tubular member 4-2 described in detail in the sixth embodiment is likewise formed to be short as shown in FIG. 4 and fixedly inserted into the extreme end of the tip 1. Further, optionally, the groove-like liquid conducting portion 22 in the outer peripheral surface of the tubular member 4-2 and the spring support portion 14 do not communicate but are independent of each other as shown in FIGS. 10A and 10B.

FIGS. 11A, 11B, 11C and 11D show a seventh embodiment of the writing tool of the present invention. A tubular member 4-3 is formed to have a length from the rear end opening of the tip 1 to the vicinity of the ball house 2 at the extreme end thereof. Tubular member 4 includes a spring supporting tubular portion 4-31 for supporting the other end of the coiled spring S in an immersed state and a partitioning portion 4-32 integrally extended from the rear end of the spring supporting tubular portion 4-31. The partitioning portion 4-32 is pressed into the tip 1 to fixedly insert the tubular member 4-3 so as to secure a liquid conducting portion 23 relative to the inner surface of the tip 1 with the partitioning portion 4-32 put therebetween. Since the seventh embodiment is basically the same in construction as that of the first embodiment described in detail except that the constituent configuration of the tubular member 4-3 itself is changed, the description thereof is omitted, and the same reference numerals are used for the same constituent parts.

The spring support tubular portion 4-31 is a closed end tube having a desired wall-thickness and which is shorter than the length of the coiled spring 5, whose length is about ⅓ to ¼ of the length of the tip 1 and whose diameter is larger than the outer diameter of the coiled spring 5. More specifically, the diameter's to such a degree that the coiled spring 5 is not in contact with the inner surface of the spring support tubular portion 4-31 in the state where the other end of the coiled spring 5 is concentrically immersed such that one end of the coiled spring 5 is loosely inserted and immersed.

The hole bottom of the spring support tubular portion 4-31 is provided with a stopping shoulder 14-1 having a diameter which is substantially the same as the outer diameter of the coiled spring 5. One end portion of the coiled spring 5 loosely inserted in an immersed manner is fixed and supported by pressing, as described in detail in the first embodiment.

The partitioning portion 4-32 secures a liquid conducting portion 23 having a desired opening sectional area relative to the inner surface of the tip 1 in the range from the rear end opening of the tip 1 to the spring support tubular portion 4-31 concentrically present in the vicinity of the seat portion 11 of the ball house 2. The partitioning portion 4-32 integrally extends from the rear end part of the spring support tubular portion 4-31 with a suitable thickness capable of firmly secured to the inner surface of the tip 1 by pressing. Its width is narrower than the inner diameter of the tip 1. As described in detail In the first embodiment, a wide fixed portion 24 is formed with substantially the same width as the inner diameter of the tip 1 within a suitable distance 1 and firmly fixed within the tip 1 by pressing to center the tubular member 4-3 with respect to the core of the tip 1.

According to the writing tool described in detail in the seventh embodiment, similarly to the aforementioned sixth embodiment, it can secure an open sectional area for feeding ink or an applying liquid M toward the ball house 2 at the extreme end of the tip 1. Therefore, this can cope with the flowability of the ink or the applying liquid M which differs with the physical properties such as viscosity, surface tension or specific gravity, etc. Even the ink or the applying liquid M having the wide physical properties according to the purpose of using the writing tool can be quickly supplied to the ball house 2 at the extreme end of the tip 1.

As described above, the writing tool described in detail in the first to seventh embodiments according to the present invention can be manufactured and provided at low cost from the fact that the number of process steps can be reduced, as compared with the lengthy coiled spring of the prior art writing tool. When the coiled spring is incorporated into the tip, centering with respect to the core of the tip, and the associated incorporating operation are considerably simpler than the prior art writing tool. In addition, the ink or the applying liquid does not leak during the use, as in the prior art writing tool.

FIGS. 12A to 19 show an eighth embodiment of the writing tool of the present invention. In the writing tool described in detail in the seventh embodiment, a tail end portion 4-33 to be projected toward the liquid tank 7 with the same thickness as that of at least the partitioning portion 4-32 located substantially in the same plane integrally extends at the rear end opening of the tip 1. After use, the writing tool is stood with the tip 1 directed upward so that ink or an applying liquid within the tip 1 moves to the partitioning portion 4-32 of the tubular member 4-3, and then to the tail end portion 4-33 extending to the liquid tank 7 without being broken from the partitioning portion 4-32 and is quickly returned to the liquid tank 7. Since the eighth embodiment is basically the same in construction as that of the seventh embodiment described in detail except that the tail end portion 4-33 integrally extends from the rear end of the telescope 4-3, the description thereof is omitted, and the same reference numerals are used for the same constituent parts.

The tail end portion 4-33 has a function that when the writing tool is stood on a pen stand or the like with the tip 1 directed upward after the use (e.g., for correction of erroneously written portions), the ink or the applying liquid M is not broken at a part of the rear end opening of the tip 1. That is, ink or an applying liquid M in a liquid conducting port 7-1 of the liquid tank 7 returns to the rear end side (tail end side) of the liquid tank 7 due to its own weight. This flow is not broken at the part of the rear end opening of the tip 1. The ink or the applying liquid M, with the aid of the partitioning portion 4-32, is quickly guided toward the light tank 7 in such a manner as to be pulled by the flow to return it into the liquid tank 7. The tail end portion is extended in the form of an angular rod having a square shaped cross section which is concentrically loosely inserted into the liquid conducting port 7-1 of the liquid tank 7 from the center of the rear end widthwise of the partitioning portion 4-32. It has the same thickness a that of the partitioning portion 4-32, and a length sufficient to project into the liquid tank 7 (see FIG. 14).

Figure 16:
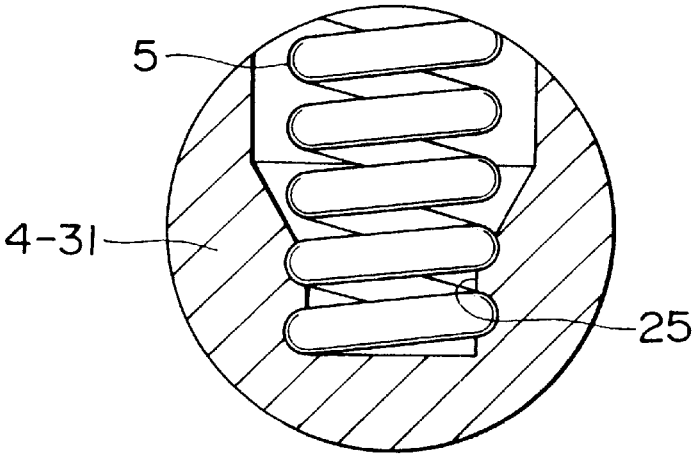
FIG. 16 is a partial enlarged view showing another embodiment of the supporting mode of the coiled spring with respect to the spring supporting tubular portion.

Also in this embodiment, the hole bottom (tubular bottom) of the spring support tubular portion 4-31 shown in FIG. 16 is provided with a stopping shoulder 25 having a diameter which is substantially the same as the outer diameter of the coiled spring 5. One end portion of the coiled spring 5 loosely inserted in an immersed manner is fixed and supported by pressing or screwing, as described in detail in the first embodiment.

Figure 17:
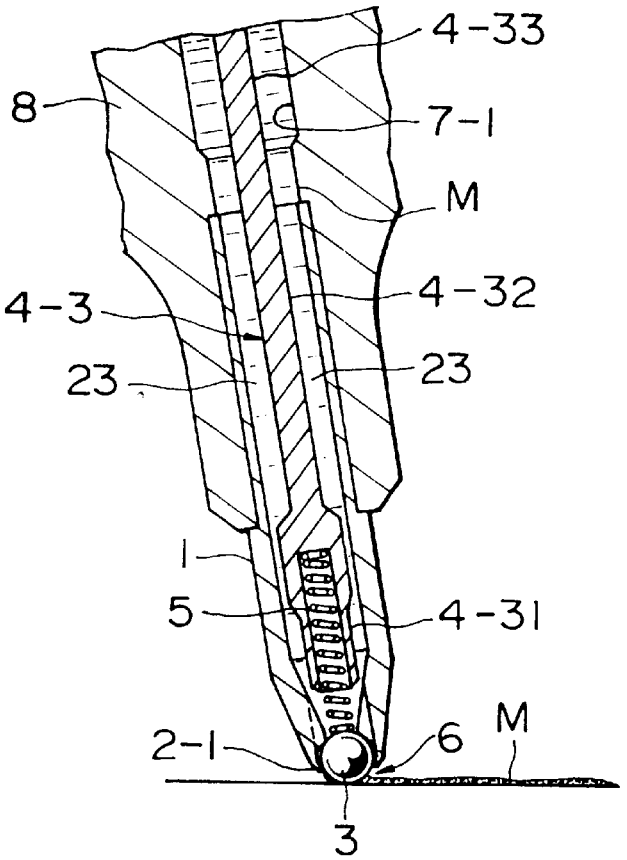

According to the writing tool described in detail in the eighth embodiment, when the writing tool is directed upward, as illustrated in FIG. 17, the ink or the applying liquid in the tip 1 flows from the partitioning portion 4-32 of the tubular member 4-3, to the tail end portion 4-33, and quickly returns to the liquid tank 7. That is, the occurrence of a curtain generated by surface tension in the part of the rear end opening of the tip 1 by the tail end portion 4-33 is avoided. Thereby, the ink or the applying liquid M is quickly returned to the liquid tank 7 without being broken from the partitioning portion 4-32 to the tail end portion 4-33 and due to the own weight. Accordingly, this embodiment prevents solidification of fluid which interferes with the operation of the coiled spring 5 to urge the rotary body 3 toward the inwardly directed extreme end edge 2-1 of the ball house 2.

Figure 18:
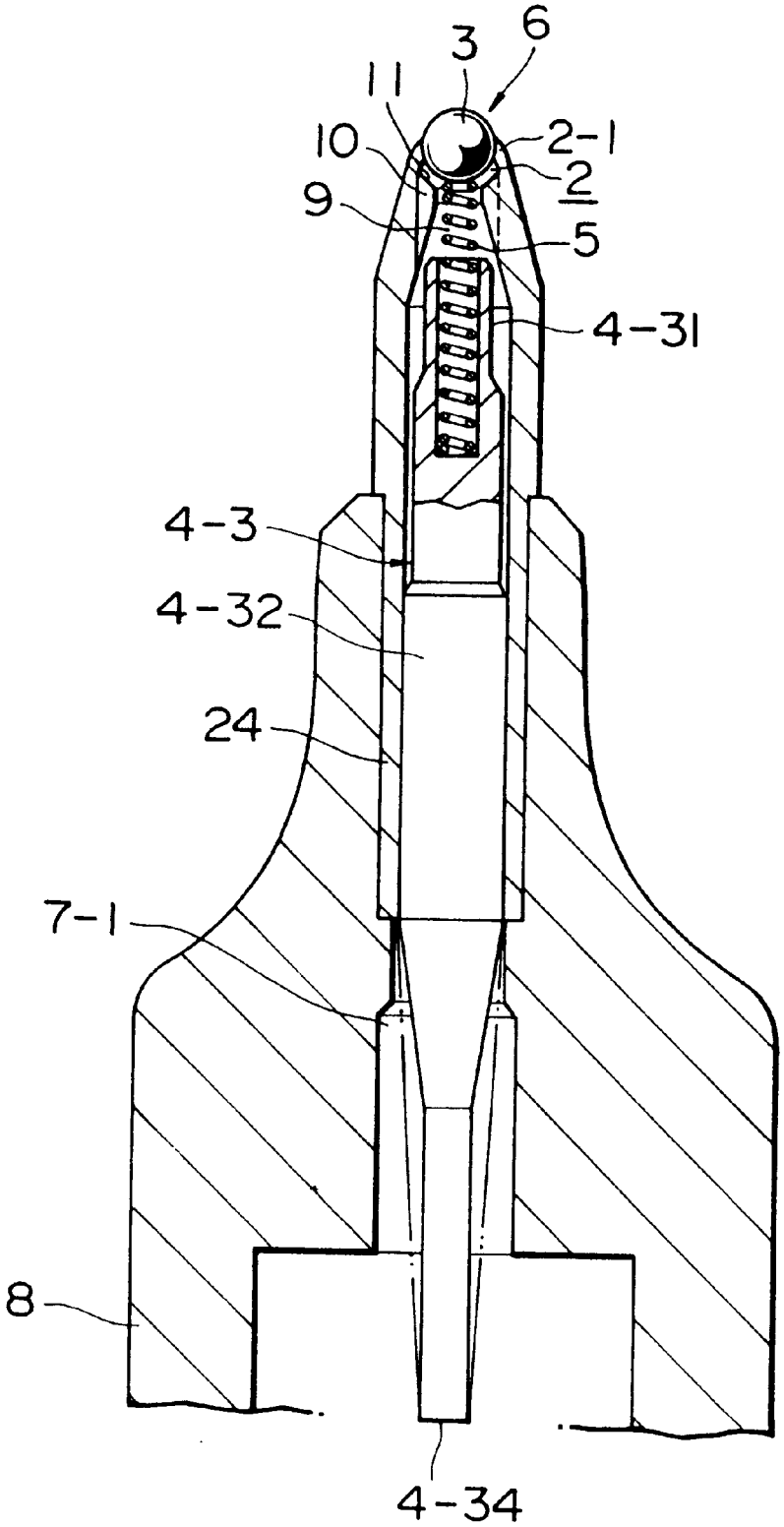
FIG. 18 is a longitudinal sectional view of main ports showing another embodiment of the projecting mode of a tail end portion.
Figure 19:
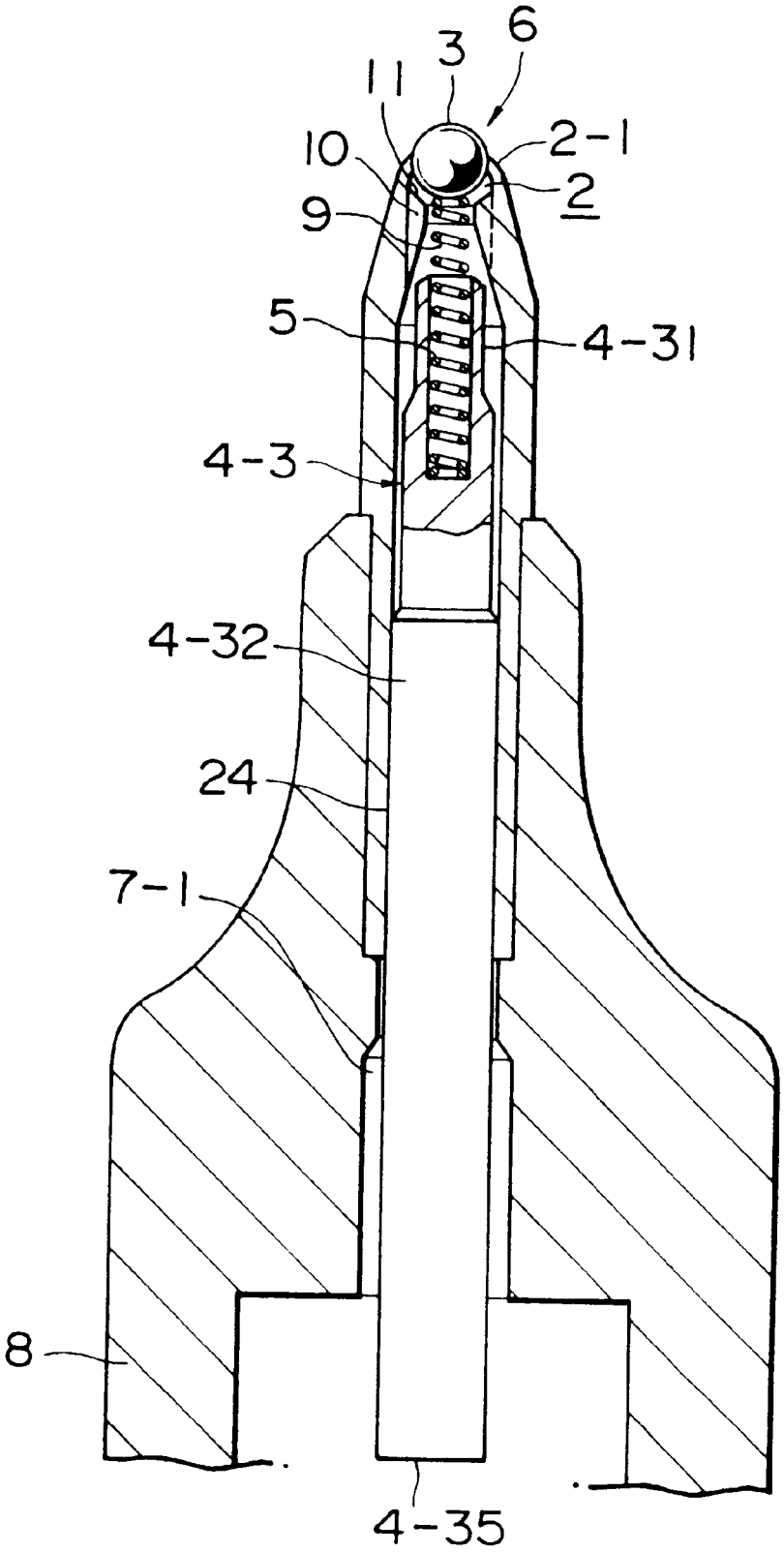
FIG. 19 is likewise a longitudinal sectional view of main ports showing still another embodiment of the projecting mode of the tail end portion.
Figure 20:
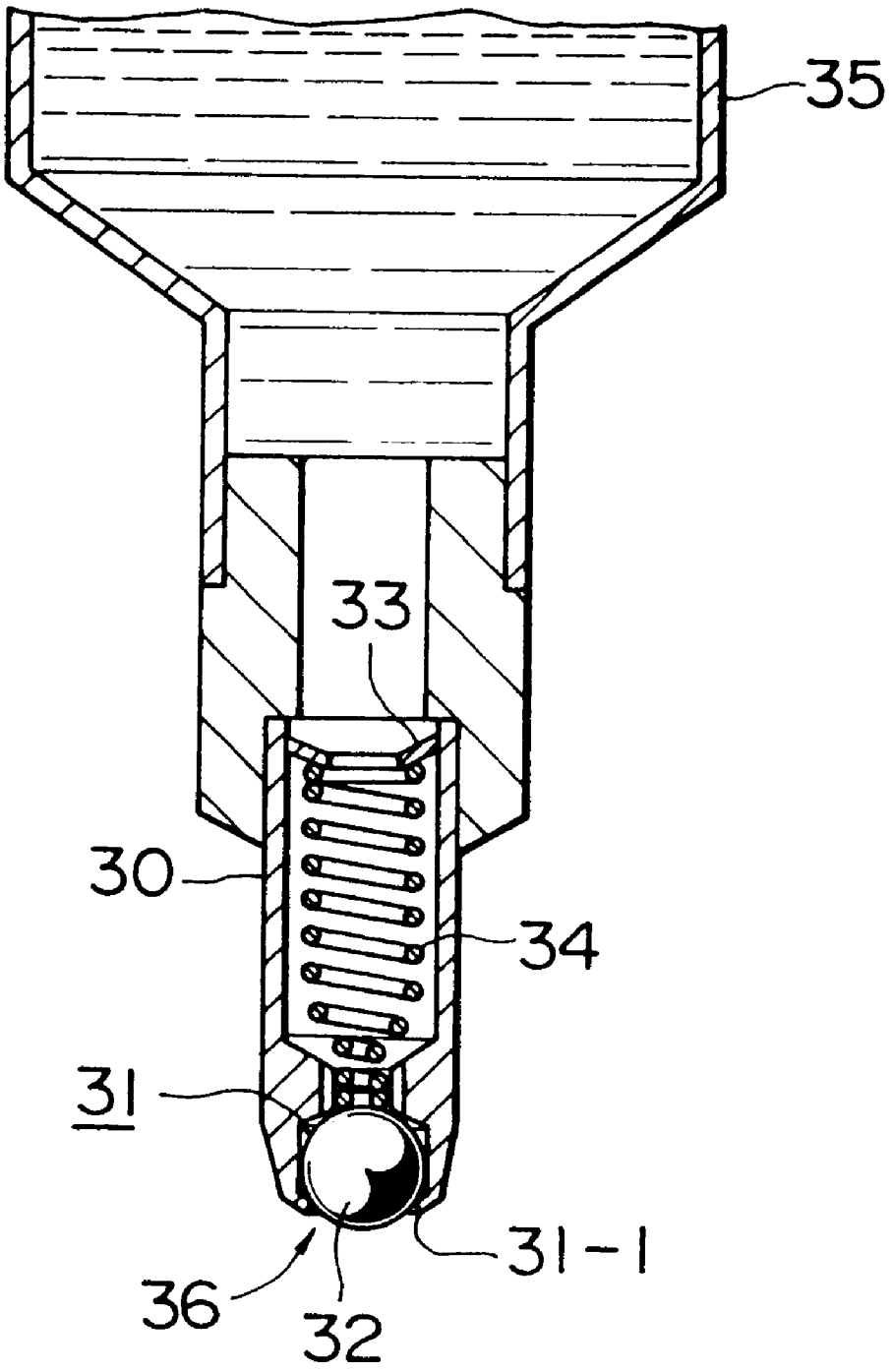
FIG. 20 is a longitudinal sectional view showing the conventional writing tool.

FIGS. 18 and 19 show another embodiment of the present invention. A tail end portion 4-34 shown in FIG. 18 extends in a gradually converged manner from both edges widthwise of the rear end of the partitioning portion 4-32 toward its projecting halfway part (solid line) or its projecting end (two-dot contour line). A tail end portion 4-35 shown in FIG. 19 extends in a web-like manner having substantially the same width as that of the partitioning portion 4-32. Similarly to the tail end portion 4-33 described in detail in the above-described embodiment, the these tail end portions 4-34 and 4-35 extend from the rear end of the partitioning portion 4-32 with the same thickness as that of the partitioning portion 4-32. When the writing tool is directed upward after use, the ink or the applying liquid M within the tip 1 returns to the liquid conducting port 7-1 of the liquid tank 7 from the part of the rear end opening of the tip 1. The ink or the applying liquid M at the extreme end in the liquid tank 7 in the vicinity of the liquid conducting port 7-1 returns to the rear end (tail end) of the liquid tank 7 due to its own weight. This flow causes the ink or the applying liquid M in the tip I together with the partitioning portion 4-32 to conduct toward the liquid tank 7 without being broken at the part of the rear end opening of the tip 1.

As described above, the writing tool of the present invention described in detail in the eighth embodiment has the function and effect, in addition to those described in the seventh embodiment, in that when the writing tool is stood on a pen stand or the like after use, the ink or the applying liquid in the tip is transmitted to the partitioning portion of the tubular member present in the tip, is transmitted to the tail end portion extending to the liquid tank without being broken from the partitioning portion and is returned into the liquid tank. Accordingly, this embodiment prevents solidification of ink or the applying liquid in the tip which might otherwise interfere with the operations of the coiled spring.

Having described specific preferred embodiments of the invention with reference to the accompanying drawings, it will be appreciated that the present invention is not limited to those precise embodiments, and that various changes and modifications can be effected therein by one of ordinary skill in the art without departing from the scope and spirit of the invention as defined by the appended claims.

What is claimed is:

1. A writing tool, comprising:

a tool body;

fluid storage tank in said body;

a tip mounted on an end of said body, said tip having an inwardly facing edge;

a rotary ball mounted in said tip;

a spring, said spring biasing said rotary ball toward said inwardly facing edge, said spring having a length shorter than said tip;

a tubular member, at least partially mounted in said tip between said body and said inwardly facing edge, said tubular member at least partially defining a fluid communication path between said fluid storage tank and said rotary ball and said tubular member concentrically supporting one end of said spring;

said tubular member having a rod shaped section that is fixedly mounted in said tip, and having a spring support section at an end at which said spring is mounted, to thereby concentrically support said spring;

a length of said spring support section being smaller than a length of said spring;

an outer diameter of said spring being smaller than an inner diameter of said spring support section; and said tubular member having a rear portion with an outer dimension substantially identical to an inner diameter of an adjacent portion of said tip, and a forward portion with an outer diameter that is smaller that of said rear section, such that said tubular member has an outer shape of a rod with a shoulder.

2. A writing tool, comprising:

a tool body;

a fluid storage tank in said body;

a tip mounted on an end of said body;

a rotary ball mounted in said tip;

a spring, said spring biasing said rotary ball in a direction toward an inwardly facing edge of said tip, said spring having a length shorter than said tip;

a tubular member, inserted into said tip, and including a partitioning portion and a spring support portion, said spring support portion being closer to said rotary ball than said partitioning portion;

said partitioning portion having a size and shape which at least partially corresponds to an adjacent portion of an inner surface of said tip such that said partitioning portion and said adjacent portion of said tip cooperate to support the tubular member relative to the tip;

said spring support portion comprising a recess having an inner diameter larger than a diameter of said spring, and a length shorter than said a length of said spring, such that said spring support portion concentrically supports one end of said spring relative to said rotary ball; and a liquid conducting portion defined between said tip and said tubular member;

wherein said spring support portion includes a shoulder having a diameter substantially identical to an outer diameter of said spring, said spring being mounted on said shoulder by at least one of pressing and screwing.

* * * * *

UNITED STATES PATENT AND TRADEMARK OFFICE

CERTIFICATE OF CORRECTION

PATENT NO. : 6,042,290

DATED : March 28, 2000

INVENTOR(S) : S. ISHIKAWA et al.

It is certified that error appears in the above-identified patent and that said Letters Patent is hereby corrected as shown below:

At column 14, line 61 (claim 1, line 3) of the printed patent, before "fluid" insert ---a---.

At column 15, line 19 (claim 1, line 27) of the printed patent, after "smaller" insert ---than---

Signed and Sealed this

Third Day of April, 2001

*Attest:*

Nicholas P. Godici

NICHOLAS P. GODICI

*Attesting Officer*

*Acting Director of the United States Patent and Trademark Office*